US009657503B2

(12) United States Patent
Hollermann et al.

(10) Patent No.: US 9,657,503 B2
(45) **Date of Patent: *May 23, 2017**

(54) DOUBLE HUNG LATCH AND JAMB HARDWARE

(71) Applicant: Marvin Lumber and Cedar Company, Warroad, MN (US)

(72) Inventors: Ross Michael Hollermann, Warroad, MN (US); Nathan H. DeBoer, Salol, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/658,834

(22) Filed: Mar. 16, 2015

(65) Prior Publication Data

US 2015/0184434 A1 Jul. 2, 2015

Related U.S. Application Data

(63) Continuation of application No. 13/872,864, filed on Apr. 29, 2013, now Pat. No. 8,978,304.
(Continued)

(51) Int. Cl.
*E05D 15/22* (2006.01)
*E05C 1/10* (2006.01)
(Continued)

(52) U.S. Cl.
CPC ..... *E05C 1/08* (2013.01); *E05B 15/0006* (2013.01); *E05B 15/0053* (2013.01);
(Continued)

(58) Field of Classification Search
CPC ..... E05C 1/08; E05C 2007/007; E05C 3/046; E05B 15/0006; E05B 63/14; E05F 7/04;
(Continued)

(56) References Cited

U.S. PATENT DOCUMENTS 398,039 A 2/1889 Flatman et al.
660,438 A 10/1900 Holly et al.
(Continued)

FOREIGN PATENT DOCUMENTS

GB 2333555 A 7/1999
WO WO-2006116675 A2 11/2006

OTHER PUBLICATIONS

"U.S. Appl. No. 14/609,174, Non Final Office Action mailed Dec. 3, 2015", 15 pgs.
(Continued)

*Primary Examiner* — Justin Rephann

(74) *Attorney, Agent, or Firm* — Schwegman Lundberg & Woessner, P.A.

(57) ABSTRACT

A fenestration operation hardware assembly includes latch mechanisms configured for coupling to respective top and bottom sashes, and a paddle member configured for coupling the latch mechanisms. The latch mechanisms include movable latch bolts, and at least one of the latch mechanisms includes an operator interface feature movable between at least initial and operating positions. In an initial position, the latch bolts are in respective projected positions, and the top and bottom panels are immobilized. In a first withdrawn position, at least one of the top and bottom panels is movable, and in a second withdrawn position, at least one of the top and bottom panels is tiltable. In an example, a top latch bolt is moved by the paddle member according to movement of the bottom latch bolt.

14 Claims, 13 Drawing Sheets

Related U.S. Application Data

(60) Provisional application No. 61/640,535, filed on Apr. 30, 2012, provisional application No. 61/790,192, filed on Mar. 15, 2013, provisional application No. 61/640,525, filed on Apr. 30, 2012, provisional application No. 61/732,763, filed on Dec. 3, 2012, provisional application No. 61/800,143, filed on Mar. 15, 2013.

(51) Int. Cl.

| | |
|---|---|
| ***E05C 1/08*** | (2006.01) |
| ***E05B 53/00*** | (2006.01) |
| ***E05B 63/14*** | (2006.01) |
| ***E05C 1/12*** | (2006.01) |
| ***E05C 3/04*** | (2006.01) |
| ***E05B 15/00*** | (2006.01) |
| ***E05C 3/12*** | (2006.01) |
| ***E06B 3/50*** | (2006.01) |
| ***E06B 7/02*** | (2006.01) |
| ***E06B 7/28*** | (2006.01) |
| ***E06B 9/00*** | (2006.01) |
| ***E05F 7/04*** | (2006.01) |
| ***E06B 3/34*** | (2006.01) |
| *E05C 17/62* | (2006.01) |
| *E05C 7/00* | (2006.01) |

(52) U.S. Cl.

CPC ..... *E05B 53/003* (2013.01); *E05B 63/14* (2013.01); *E05C 1/10* (2013.01); *E05C 1/12* (2013.01); *E05C 3/046* (2013.01); *E05C 3/12* (2013.01); *E05C 3/124* (2013.01); *E05D 15/22* (2013.01); *E05F 7/04* (2013.01); *E06B 3/341* (2013.01); *E06B 3/5063* (2013.01); *E06B 7/02* (2013.01); *E06B 7/28* (2013.01); *E06B 9/00* (2013.01); *E05C 17/62* (2013.01); *E05C 2007/007* (2013.01); *Y10T 292/0836* (2015.04); *Y10T 292/1039* (2015.04)

(58) Field of Classification Search

CPC ..... E06B 3/341; E06B 3/5063; E06B 7/02; E05D 15/22

USPC ..... 49/176, 183, 184, 185, 449; 292/32, 33, 292/37, 38, 42, 137, 163, DIG. 20, 292/DIG. 47

See application file for complete search history.

(56) References Cited

U.S. PATENT DOCUMENTS

| | | | | |
|---|---|---|---|---|
| 1,434,371 | A | 11/1922 | Crompton et al. | |
| 2,104,134 | A | 1/1938 | Mellebrand | |
| 2,274,711 | A | 3/1942 | Krause | |
| 2,545,645 | A | 3/1951 | Blakely | |
| 2,778,326 | A | 1/1957 | Guzik | |
| 2,883,225 | A | 4/1959 | Akehurst | |
| 2,967,595 | A | 1/1961 | Zitomer | |
| 4,351,288 | A | 9/1982 | Gasloli | |
| 4,624,073 | A | 11/1986 | Randall | |
| 4,639,021 | A | 1/1987 | Hope | |
| 5,090,750 | A | 2/1992 | Lindqvist | |
| 5,301,989 | A | 4/1994 | Dallmann et al. | |
| 5,398,447 | A | 3/1995 | Morse | |
| 5,437,173 | A | 8/1995 | Spinar | |
| 5,592,781 | A | 1/1997 | Mauro | |
| 5,791,700 | A | 8/1998 | Biro | |
| 5,992,907 | A | 11/1999 | Sheldon et al. | |
| 6,141,913 | A | 11/2000 | Wong et al. | |
| 6,176,041 | B1 | 1/2001 | Roberts | |
| 6,588,150 | B1 | 7/2003 | Wong et al. | |
| 6,669,242 | B2 | 12/2003 | Fountaine et al. | |
| 6,672,009 | B1 | 1/2004 | Wong et al. | |
| 6,817,142 | B2 | 11/2004 | Marshik et al. | |
| 6,871,885 | B2 | 3/2005 | Goldenberg et al. | |
| 6,877,784 | B2 | 4/2005 | Kelley et al. | |
| 6,938,373 | B2 | 9/2005 | Wong et al. | |
| 6,957,513 | B2 | 10/2005 | Pettit et al. | |
| 7,013,603 | B2 | 3/2006 | Eenigenburg et al. | |
| 7,070,215 | B2 | 7/2006 | Kelley et al. | |
| 7,118,142 | B2 | 10/2006 | Xu | |
| 7,165,791 | B2 | 1/2007 | Rebel et al. | |
| 7,322,619 | B2 | 1/2008 | Nolte et al. | |
| 7,407,199 | B2 | 8/2008 | Richardson | |
| 7,412,800 | B2 | 8/2008 | Maier | |
| 7,481,470 | B2 | 1/2009 | Eenigenburg et al. | |
| 7,591,494 | B2 | 9/2009 | Mitchell | |
| 7,607,262 | B2 | 10/2009 | Pettit et al. | |
| 7,731,251 | B2 | 6/2010 | Ye | |
| 7,812,800 | B2 | 10/2010 | Peng et al. | |
| 7,874,598 | B2 | 1/2011 | Chung | |
| 7,963,577 | B2 | 6/2011 | Wolf | |
| 7,976,077 | B2 * | 7/2011 | Flory | E05B 53/003 292/241 |
| 8,020,904 | B2 | 9/2011 | Flory et al. | |
| 8,182,001 | B2 | 5/2012 | Tremble et al. | |
| 8,205,920 | B2 * | 6/2012 | Flory | E05B 13/004 292/241 |
| 8,955,255 | B2 | 2/2015 | DeBoer et al. | |
| 8,978,304 | B2 | 3/2015 | Hollermann et al. | |
| 2002/0116874 | A1 | 8/2002 | Marshik | |
| 2003/0084614 | A1 | 5/2003 | Pettit et al. | |
| 2003/0110698 | A1 | 6/2003 | Polowinczak et al. | |
| 2003/0110699 | A1 | 6/2003 | Eenigenburg et al. | |
| 2004/0003541 | A1 | 1/2004 | Wong et al. | |
| 2004/0168370 | A1 | 9/2004 | Pettit et al. | |
| 2004/0195843 | A1 | 10/2004 | Rotondi et al. | |
| 2004/0200150 | A1 | 10/2004 | Kelley et al. | |
| 2005/0097823 | A1 | 5/2005 | Marshik | |
| 2006/0225354 | A1 | 10/2006 | Kelley et al. | |
| 2006/0244270 | A1 | 11/2006 | Rotondi | |
| 2007/0046036 | A1 * | 3/2007 | Kinsey | E05B 65/0841 292/228 |
| 2007/0209281 | A1 | 9/2007 | Flory et al. | |
| 2008/0129054 | A1 | 6/2008 | Tremble et al. | |
| 2008/0163551 | A1 | 7/2008 | Nolte et al. | |
| 2009/0241429 | A1 | 10/2009 | Polowinczak et al. | |
| 2010/0050528 | A1 | 3/2010 | Pettit et al. | |
| 2010/0218425 | A1 | 9/2010 | Nolte et al. | |
| 2010/0263415 | A1 * | 10/2010 | Ruspil | E05B 63/20 70/89 |
| 2011/0113695 | A1 | 5/2011 | Derham | |
| 2011/0192089 | A1 | 8/2011 | Barton et al. | |
| 2011/0296880 | A1 | 12/2011 | Sieglaar et al. | |
| 2011/0304163 | A1 * | 12/2011 | Liang | E05B 63/20 292/242 |
| 2012/0313386 | A1 * | 12/2012 | Liang | E05C 3/046 292/224 |
| 2012/0313387 | A1 * | 12/2012 | Liang | E05B 17/2019 292/224 |
| 2013/0214545 | A1 * | 8/2013 | Wolf | E05C 3/046 292/241 |
| 2013/0283694 | A1 | 10/2013 | Deboer et al. | |
| 2013/0283695 | A1 | 10/2013 | Hollermann et al. | |
| 2014/0230331 | A1 * | 8/2014 | Kellum, III | E05D 13/06 49/352 |
| 2015/0167377 | A1 | 6/2015 | Deboer et al. | |
| 2015/0184434 | A1 | 7/2015 | Hollermann et al. | |

OTHER PUBLICATIONS

"U.S. Appl. No. 14/609,174, Response filed Mar. 1, 2016 to Non Final Office Action mailed Dec. 3, 2015", 10 pgs.

"U.S. Appl. No. 14/609,174, Response filed Nov. 17, 2015 to Restriction Requirement mailed Sep. 11, 2015", 9 pgs.

"U.S. Appl. No. 14/609,174, Restriction Requirement mailed U.S. Appl. No. 14/609,174, Restriction Requirement mailed Sep. 11, 2015", 9 pgs.

(56) References Cited

OTHER PUBLICATIONS

"U.S. Appl. No. 13/872,842, Examiner Interview Summary mailed Aug. 15, 2014", 3 pgs.
"U.S. Appl. No. 13/872,842, Non Final Office Action mailed Apr. 11, 2014", 16 pgs.
"U.S. Appl. No. 13/872,842, Notice of Allowance mailed Sep. 29, 2014", 10 pgs.
"U.S. Appl. No. 13/872,842, Response filed Mar. 6, 2014 to Restriction Requirement mailed Jan. 6, 2014", 13 pgs.
"U.S. Appl. No. 13/872,842, Response filed Sep. 3, 2014 to Non-Final Office Action mailed Apr. 11, 2014", 24 pgs.
"U.S. Appl. No. 13/872,842, Restriction Requirement mailed Jan. 6, 2014", 9 pgs.
"U.S. Appl. No. 13/872,864, Amendment and Response filed Aug. 22, 2014 to Final Office Action mailed May 23, 2014", 14 pgs.
"U.S. Appl. No. 13/872,864, Corrected Notice of Allowance mailed Dec. 1, 2014", 2 pgs.
"U.S. Appl. No. 13/872,864, Non Final Office Action mailed May 23, 2014", 14 pgs.
"U.S. Appl. No. 13/872,864, Notice of Allowance mailed Nov. 10, 2014", 10 pgs.
"U.S. Appl. No. 13/872,864, Response filed Mar. 26, 2014 to Restriction Requirement mailed Feb. 3, 2014", 9 pgs.
"U.S. Appl. No. 13/872,864, Response filed Aug. 22, 2014 to Non Final Office Action mailed May 23, 2014", 14 pgs.
"U.S. Appl. No. 13/872,864, Restriction Requirement mailed Feb. 3, 2014", 7 pgs.
"U.S. Appl. No. 14/609,174, Preliminary Amendment filed Mar. 5, 2015", 8 pgs.
"European Application Serial No. 11154029.0, European Search Report and Opinion mailed Sep. 25, 2012", 7 pgs.
"Kolbe & Kolbe Windows & Doors", [online] [retrieved Apr. 23, 2012]. Retrieved from the Internet: <URL: http://www.kolbe-kolbe.com/>, 1 pg.
Sopkowiak, J., et al., "Sash Limited Apparatus and Method", U.S. Appl. No. 13/328,776, filed Dec. 16, 2011, 67 pgs.
Sopkowiak, J., et al., "Sash Limiter Apparatus and Method", U.S. Appl. No. 61/486,813, filed May 17, 2011, 63 pgs.
"U.S. Appl. No. 14/609,174, Applicant Interview Summary filed Apr. 12, 2016", 1 pgs.
"U.S. Appl. No. 14/609,174, Notice of Allowance mailed May 2, 2016", 12 pgs.
"U.S. Appl. No. 14/609,174, Notice of Allowance mailed Aug. 9, 2016", 8 pgs.

* cited by examiner

DOUBLE HUNG LATCH AND JAMB HARDWARE

CLAIM OF PRIORITY

This patent application is a Continuation of U.S. patent application Ser. No. 13/872,864, filed Apr. 29, 2013; entitled DOUBLE HUNG LATCH AND JAMB HARDWARE, which claims priority to U.S. patent application Ser. Nos. 61/640,535, filed on Apr. 30, 2012; entitled DOUBLE HUNG LATCH AND JAMB HARDWARE, 61/790,192, filed on Mar. 15, 2013; entitled DOUBLE HUNG LATCH AND JAMB HARDWARE, 61/640,525, filed on Apr. 30, 2012; entitled DOUBLE HUNG OPERATION HARDWARE, 61/732,763, filed on Dec. 3, 2012; entitled DOUBLE HUNG OPERATION HARDWARE and 61/800,143, filed on Mar. 15, 2013; entitled DOUBLE HUNG OPERATION HARDWARE and are incorporated by reference herein.

This patent application is also related to U.S. patent application Ser. No. 13/872,842, filed Apr. 29, 2013; entitled DOUBLE HUNG OPERATION HARDWARE, Ser. No. 14/609,174, filed Jan. 29, 2015; entitled DOUBLE HUNG OPERATION HARDWARE, and are incorporated by reference herein.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Windows and Doors; Warroad, Minn. All Rights Reserved.

TECHNICAL FIELD

This document pertains generally, but not by way of limitation, to fenestration operation hardware.

BACKGROUND

Tilt latches are used with some examples of double hung windows to facilitate window sash tilting. Tilting a window sash allows for cleaning the interior and exterior of the window sash, such as while the operator is located, for instance, indoors. In some examples, tilt latches are actuated by an operator applying hand pressure to tilt latches that are otherwise biased outwardly into adjacent jambs. Actuation of the tilt latches allows for tilting of the window sash.

In some examples, the operator must simultaneously actuate each of two tilt latches installed on opposite sides of the window sash to enable tilting of the sash. The tilt latches are individually operated and held in a retracted orientation to permit tilting. In other words, the tilt latches are biased into the projected orientation when released, and it is correspondingly difficult to actuate each of the tilt latches while tilting the sash at the same time.

Additionally, at least some examples of tilt latches are located in the center on the bottom check rail. This location coincides with the center of the frame balance tube. This arrangement limits the engagement available for the latch within the jamb, hinders structural performance (e.g., security and wind load), and limits the size of sash balances. Further, where tilt latches are incorporated in a bottom check rail, a pocket is created in the check rail that spans the slot and tenon joints to house the tilt latch and its components (e.g., a latch housing, a tilt latch bolt, a spring to bias the tilt latch bolt, pins or slides for finger or hand actuation, access orifices to reach the pins or slides, and the like). This arrangement compromises the strength of the joints.

OVERVIEW

The present inventors have recognized, among other things, that a problem to be solved can include automatically locking one or more sashes or panels of a double hung window or sliding door after movement of one of the sashes from a closed position. In an example, the present subject matter can provide a solution to this problem, such as by including a top latch bolt that is interfaced with a bottom latch bolt at a latch bolt interface. Upon movement of one of the sashes, for instance, the bottom sash relative to the top sash, the top latch bolt disengages from the bottom latch bolt and automatically seats itself within a locking recess provided in the frame or a jamb component of the frame to correspondingly lock the top sash. The automatic locking provided by the separable top and bottom latch bolts replaces or supplements the locking provided by a sweep and keeper mechanism positioned between check rails.

Additionally, while the check rails of the top and bottom sashes are aligned in a closed position, a latch bolt interface including a jamb paddle assembly allows cooperative unlocking of each of the top and bottom sashes. Upon movement of one or both of the sashes, the latch bolt interface is interrupted and the top and bottom latch bolts work independently. For instance, if the top sash is moved, the top latch bolt may remain in a withdrawn position because the bolt head engages with a sash groove cover or a sash groove that does not include a locking recess. In an example, if the bottom sash is moved first, the top sash automatically relocks itself by reseating within its locking recess, as described above. Even where the top sash is moved first, upon repositioning the top sash at the closed position, the top latch bolts automatically lock the top sash in place (e.g., with the bottom sash locked or open), and thereby avoid issues caused by top sash sag, and ensure engagement of an optional sweep and keeper.

The inventors have further recognized, among other things, that a problem to be solved can include conveniently locking and unlocking one or both of the top and bottom sashes at an easily accessible location. In an example, a composite latch assembly provided by the top and bottom latch mechanisms described herein allows locking and unlocking of the sashes (as well as positioning in secure vent locations and automatic locking of one or more of the sashes) with the latch mechanisms and operation hardware assembly positioned centrally within the window, for instance at the check rails. A single operator can readily operate the composite latch assembly as described herein without requiring tools, such as extension poles, ladders and the like. Moreover, the top and bottom latch assemblies are concealed between the check rails, for instance at the interface therebetween, and thereby enhances an aesthetic appeal of the window compared to surface mounted hardware.

The inventors have still further recognized, among other things, that a problem to be solved can include reengaging separated latch mechanisms of a distributed composite latch assembly. In an example, the composite latch assembly includes top and bottom latch bolts that interface at a bolt interface until disengaged by movement of one or both of the sashes. In this example, the bottom latch bolt includes a latch cam driver and the top latch bolt includes a corresponding top latch bolt follower. Each of these features include tapered surfaces to ensure reengagement of the latch bolts without requiring resetting of the operation hardware assembly where the latch bolts are at different positions (e.g., one is withdrawn, the other projected) at reengagement. Further, the tapered surfaces ensure the top latch bolt is biased into a withdrawn configuration if the bottom latch bolt is in a withdrawn configuration because of the position of the operation hardware assembly (e.g., the operator mechanism is locked in place according to the function of the mechanism).

The present inventors have still further recognized, among other things, that a problem to be solved can include eliminating redundant hardware used in separate mechanisms for operating tilt mechanisms and locking and unlocking of sashes for movement within a frame. In an example, the present subject matter can provide a solution to this problem, for instance with an operation hardware assembly that remotely actuates latch bolts to lock and unlock a sash for sliding movement within a frame and also further actuate the latch bolts to permit tilting of the sash. The operation hardware assembly consolidates tilting and locking/unlocking functions into a single assembly that is actuated with an operator, such as a rotatable handle. Separated and independently operated hardware including rotating sweeps with keepers and tilt latches are thereby avoided.

Further, the operation hardware assembly examples described herein are usable to independently lock and unlock top and bottom sashes without sweeps and keepers extending between opposed check rails. In one example, the bottom sash is locked relative to the frame with latch bolts actuated through an operator, such as a rotatable handle. The latch bolts are received within corresponding recesses in the frame, for instance jamb components including recesses sized and shaped to receive the latch bolts. Optionally, the top sash includes latch bolts that are sized and shaped to fit within corresponding recesses and thereby independently lock the top sash in place. Alternatively, the latch bolts of the top and bottom sashes are cooperatively opened, for instance by selectively coupling the bolts at the interface of the check rails.

Further still, with jamb components including one or more of planar surfaces, recesses, tapered features, a cam, and a cam follower, the operation hardware assembly including the latch bolts provides additional functionality including, but not limited to, automatic locking of one or more of the sashes in the closed position, a secure venting position, or any other positions within the range of movement for the sash, positioning of the bottom sash in a secure vent position (e.g., with the bottom of the bottom sash at around 4 inches above the sill), and even function of the operation hardware assembly as a window opening control device to allow for limited opening of the sashes to a specified elevation.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
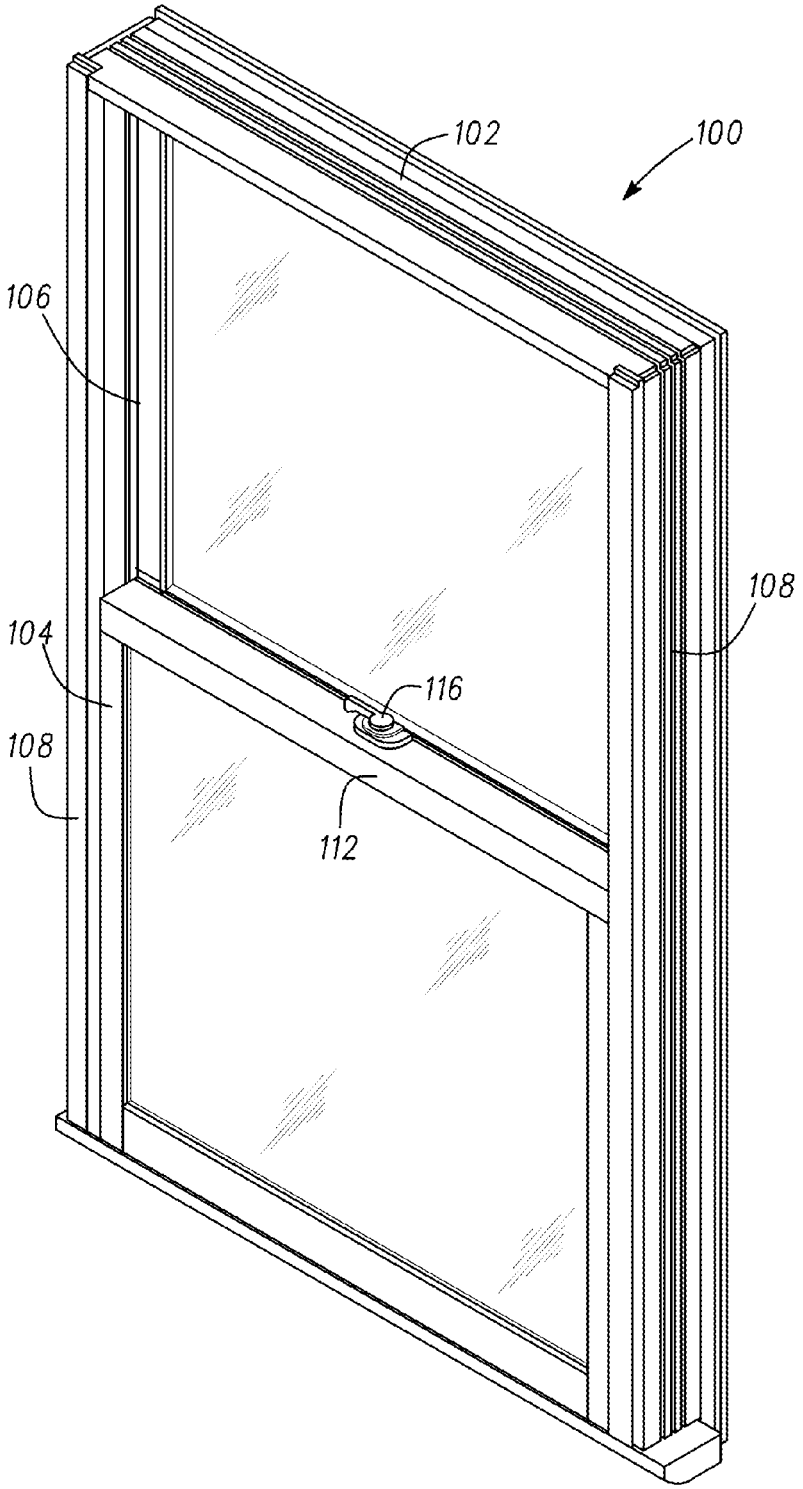
FIG. 1 is a perspective view of one example of a fenestration assembly in a closed position.

FIG. 1 is a perspective view of one example of a fenestration assembly 100 in a closed configuration. In an example, the fenestration assembly 100 includes but is not limited to a double hung window or sliding door. As shown, the fenestration assembly 100 includes a frame 102, and first and second sliding panels such as a bottom sash 104 and a top sash 106. In the example shown in FIG. 1, each of the bottom and top sashes 104, 106 includes glass panes therein. Corresponding bottom and top check rails 112, 114 are included at an interface between the bottom and top sashes 104, 106. As further shown in FIG. 1, the fenestration assembly 100 includes an operator 116 sized and shaped to operate various hardware assemblies, discussed herein, such as including hardware to lock and unlock one or more of the bottom and top sashes 104, 106.

Figure 10:
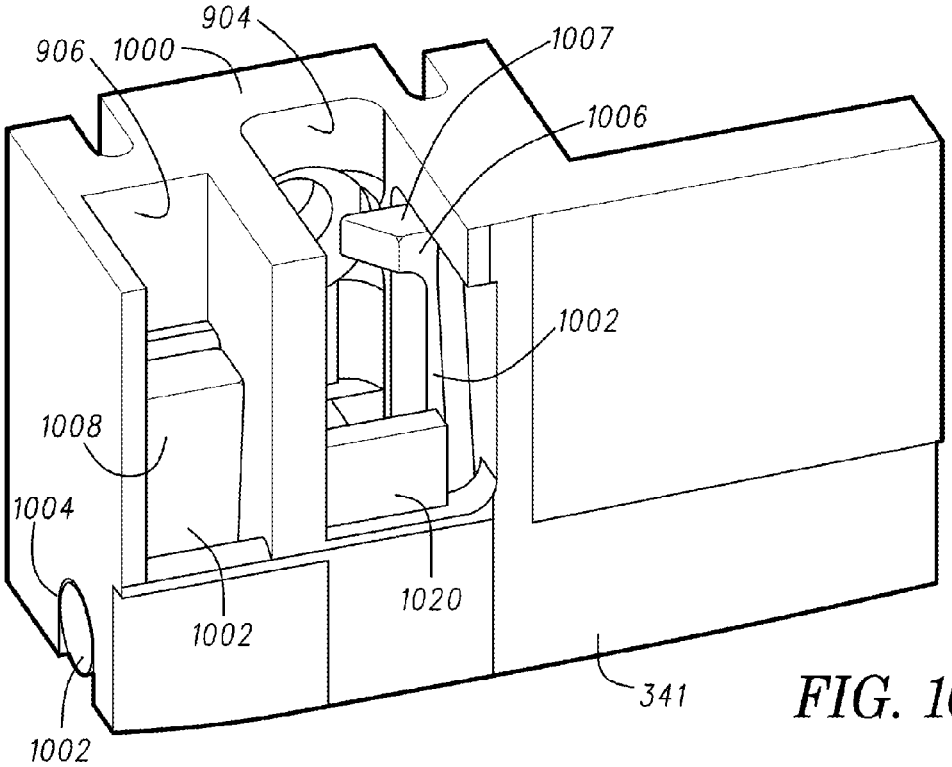
FIG. 10 is a perspective view showing a jamb receiver block and jamb paddle assembly.

In an example, the fenestration assembly 100 includes a fenestration operation hardware assembly (see, e.g., FIGS. 3 and 4) that selectively permits or inhibits translation of the bottom and top sashes 104, 106, and selectively permits or inhibits tilting of the bottom sash 104. In an example, the hardware assembly includes, among other components, latch bolt mechanisms on each of the bottom and top sashes 104, 106 at their respective bottom and top check rails 112, 114, the operator 116, and a transmission assembly that operatively couples latch bolts corresponding to the bottom and top sashes 104, 106. The transmission assembly, further shown in the subsequent figures, such as in FIG. 10, is positioned in the frame 102 adjacent to the bottom and top check rails 112, 114 when the fenestration assembly 100 is in the closed position shown in FIG. 1. As will be further described herein, movement of a latch bolt corresponding to the bottom sash 104 is transmitted (using the transmission assembly) to a latch bolt corresponding to the top sash 106, such as by operation of a jamb paddle assembly (see, e.g., FIG. 10). In an example, rotation of the jamb paddle assembly by the bottom sash latch bolt correspondingly moves the top latch bolt in a similar fashion.

The bottom sash latch bolt is operable in a projected configuration in which the bottom sash 104 is precluded from translating or tilting relative to the frame 102. The bottom sash latch bolt is further operable in a first withdrawn configuration in which the bottom sash 104 is permitted to translate relative to the frame 102 (e.g., upward), but is precluded from tilting. The bottom sash latch bolt is further operable in a second, further withdrawn configuration in which the bottom sash 104 is permitted to translate or tilt relative to the frame 102. In an example, the bottom sash latch bolt is operated remotely using the operator 116. The top sash latch bolt is operable in a projected configuration in which the top sash 106 is precluded from translating relative to the frame 102, and the top sash latch bolt is operable in a withdrawn configuration in which the top sash 106 is permitted to translate relative to the frame 102 (e.g., downward). In an example, the frame 102 includes one or more grooves configured to receive the latch bolts when they are in the respective withdrawn positions and the respective bottom and top sashes 104, 106 are translatable relative to the frame 102.

Figure 2A:
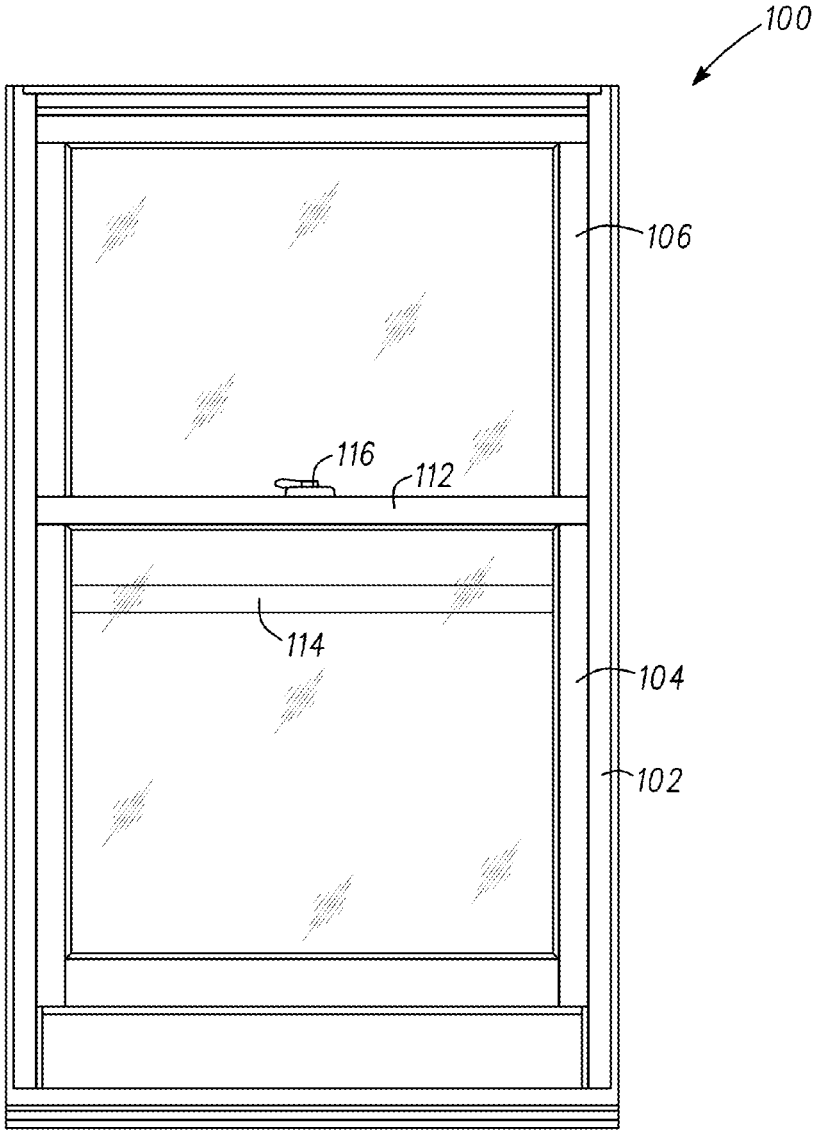
FIG. 2A is a front view of one example of a fenestration assembly with a bottom sash partially open.

Referring to FIG. 2A, a front view of one example of the fenestration assembly 100 is shown with a bottom sash partially open. For instance, the bottom sash 104 is elevated relative to the position originally shown in FIG. 1. The bottom check rail 112 is disengaged from or out of alignment with the top check rail 114. As will be described herein, latch mechanisms associated with the respective check rails 112, 114 operate according to an interface provided in the frame 102 adjacent to the check rails 112, 114. In an example, disengagement of the check rails allows one or more of these latch mechanisms to operate independently, such as to separately lock or unlock the bottom or top sash 104, 106 independently or dependently.

Figure 2B:
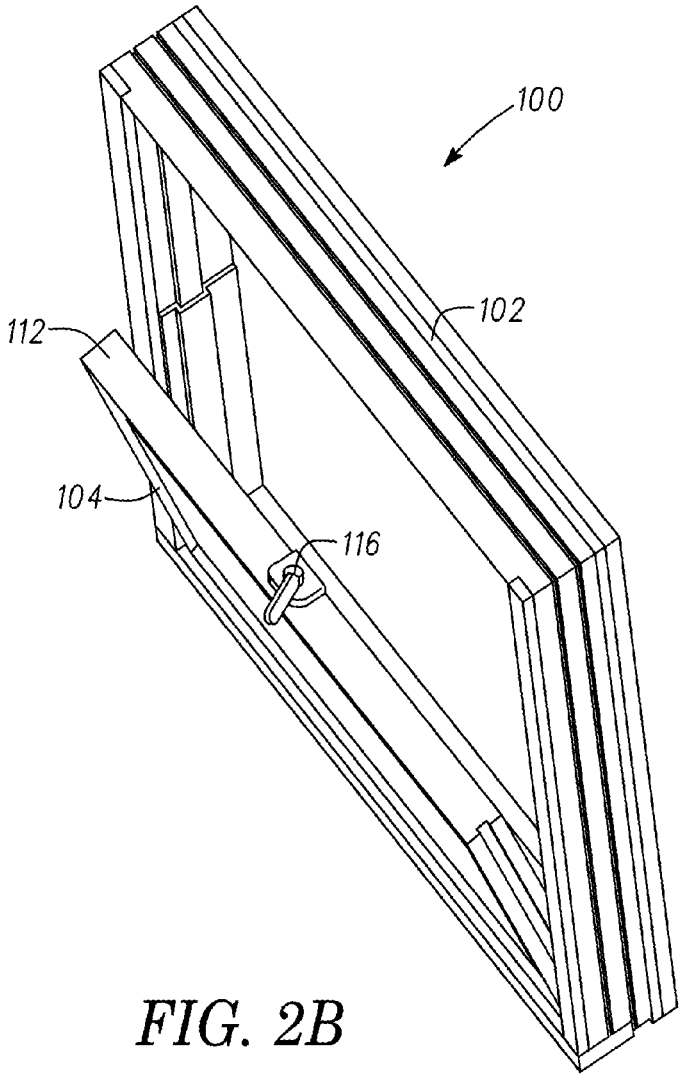
FIG. 2B is a front view of one example of a fenestration assembly with a bottom sash partially tilted.

FIG. 2B shows a front view of one example of the fenestration assembly 100 with a bottom sash partially tilted. For instance, the bottom sash 104 is tilted relative to the position originally shown in FIG. 1. The bottom check rail 112 is disengaged from or out of alignment with the top check rail 114. In an example, disengagement of the check rails allows at least the bottom sash 104 to tilt away from the frame 102, such as to provide a larger fenestration opening or to facilitate cleaning.

Figure 3:
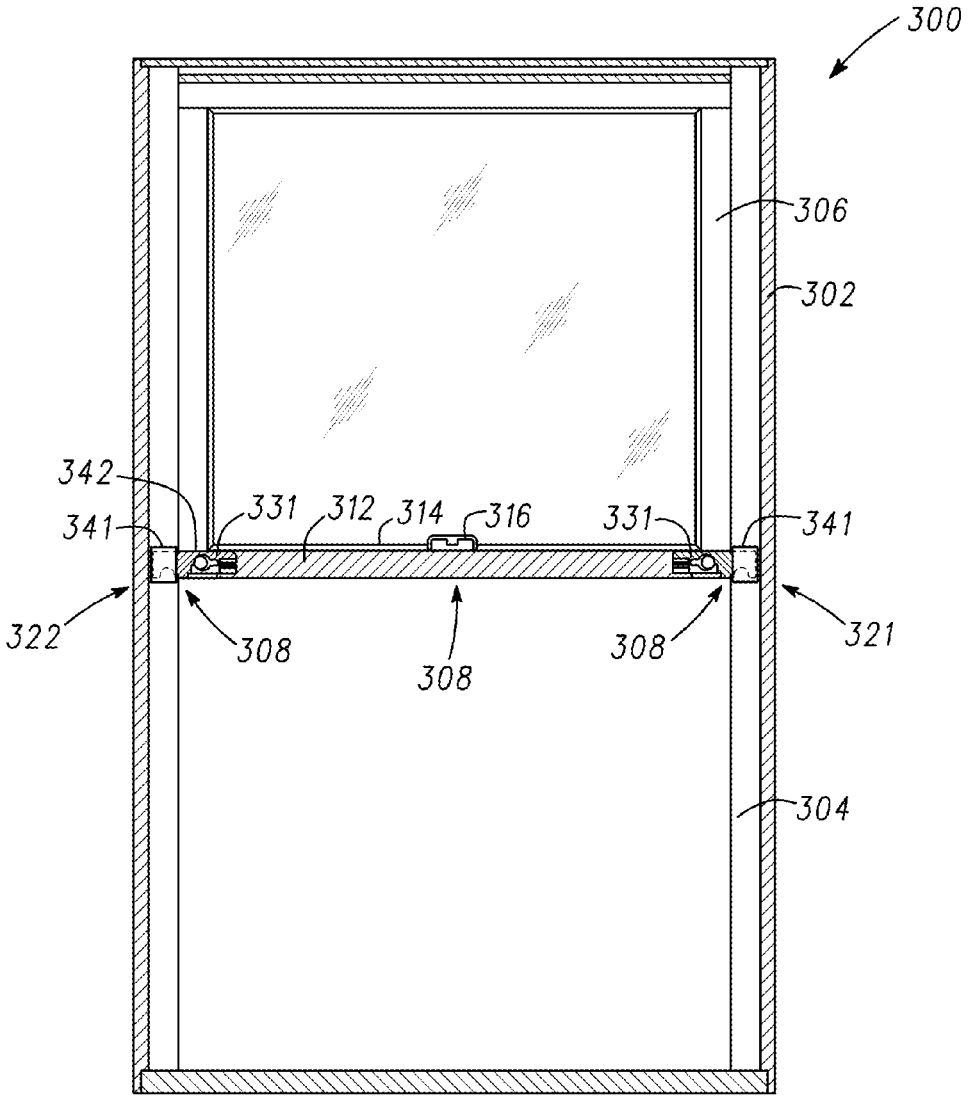
FIG. 3 is a cross sectional view of the fenestration assembly shown in FIG. 1 including an example of an operation hardware assembly installed within the sashes.

FIG. 3 is a cross sectional view of a fenestration assembly 300 including an example of an operation hardware assembly 308 installed within bottom and top sashes 304 and 306 and a frame 302. The bottom and top sashes 304, 306 are slidably positioned within the frame 302. As shown in FIG. 3, each of the bottom and top sashes 304, 306 include corresponding bottom and top check rails 312, 314. In the view shown in FIG. 3, the bottom check rail 312 is in front of the top check rail 314. Stated another way, in the front view shown in FIG. 3, the bottom check rail 312 and the top check rail 314 are coincident with one another and the bottom and top sashes 304, 306 are in the closed position.

In the example of FIG. 3, the operation hardware assembly 308 includes an operator 316 mounted on the bottom check rail 312. For instance, as shown in FIG. 3, the operator 316 is installed within a portion of the bottom check rail 312. The operation hardware assembly 308 further includes first and second latch mechanisms 321, 322 positioned on either side of the bottom check rail 312 and remote relative to the operator 316. The operation hardware assembly 308 further includes first and second transmission assemblies comprising respective first and second jamb receiver blocks 341, 342, such as positioned adjacent the first and second latch mechanisms 321, 322, when the bottom and top sashes 304, 306 are in a fully closed configuration. As will be described herein, the operator 316 is operable to move one or more latch bolts from the first and second latch mechanisms 321, 322, such as into or out of the respective first and second jamb receiver blocks 341, 342. For instance, the operator 316 is operable to move one or more latch bolts associated with the latch mechanisms, such as to allow for tilting or sliding movement of at least the bottom sash 304, and optionally the top sash 306, relative to the frame 302.

In an example, the operator 316 is movable to a first position wherein one or more latch bolts corresponding to the bottom sash 304 are withdrawn from a projected position to a first withdrawn position such that the bottom sash 304 is slidable within the frame 102. In an example, the operator 316 is movable to a second position, such as when the bottom sash 304 is translated from its fully closed position. When the operator 316 is in the second position, one or more of the latch bolts corresponding to the bottom sash 304 are further withdrawn from the first withdrawn position to a second withdrawn position such that the bottom sash 304 is tiltable away from the frame 102. In an example, the operator 316 is precluded from occupying the second position when the bottom sash 304 is in the fully closed position (see, e.g., the configuration of FIG. 1).

Figure 4:
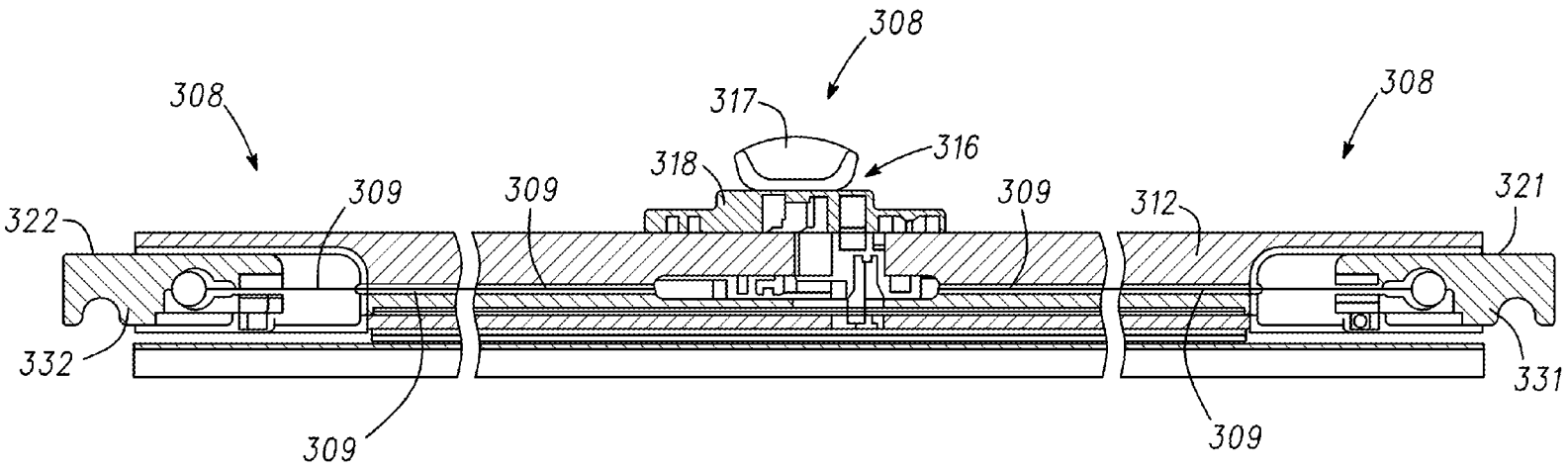
FIG. 4 is a detailed cross sectional view showing one example of an operation hardware assembly.

Referring now to FIG. 4, a detailed cross-sectional view of the bottom check rail 312 is provided. In the example of FIG. 4, the operation hardware assembly 308 is shown distributed along the bottom check rail 312 with the first and second bottom latch bolt mechanisms 321, 322 positioned at either end of the bottom check rail 312, and the operator 316 positioned substantially centrally on the bottom check rail 312.

As shown in FIG. 4, the operator 316 includes an operator interface feature 317. In one example, the operator interface feature 317 includes, but is not limited to, a handle, slide mechanism, finger pull, or the like. The operator interface feature 317 is coupled with an operator housing 318. In one example, the operator housing 318 includes a mechanism of the operator 316 therein and optionally further provides for rotatable coupling of the operator interface feature 317.

In the example of FIG. 4, the first and second bottom latch bolt mechanisms 321, 322 are positioned at either end of the bottom check rail 312. The first and second bottom latch bolt mechanisms 321, 322 include respective first and second latch bolts 331, 332, such as corresponding to the bottom check rail 312. In an example, the first and second latch bolts 331, 332 are operated, for instance, by tensioning or pulling a flexible element such as a tying element 309. The tying element 309 extends between each of the first and second bottom latch bolts 331, 332 and the operator 316. In an example, rotation or other movement of the operator interface feature 317 moves the tying element 309 and accordingly moves one or both of the first and second latch bolts 331, 332. For instance, rotation of an operator interface feature 317 (e.g., a handle) pulls the tying element 309 inwardly, toward the operator 316 (e.g., using one or more spools to collect or wind the tying element 309), and thereby accordingly withdraws one or both of the first and second bottom latch bolts 331, 332 from a projected position (e.g., as shown in FIG. 4) to one or more withdrawn positions. In the withdrawn positions, one or more of the bottom and top sashes 304, 306 is slidable between open and closed configurations, or the bottom sash 304 is optionally tiltable relative to the frame 302. As further discussed below, such as in the discussion of FIG. 10, the bottom sash 304 is tiltable relative to the frame 302 when the bottom sash 304 is elevated, or translated relative to the closed configuration. Optionally, the bottom sash 304 is not titlable relative to the frame 302 from the fully closed configuration.

Figure 5A:
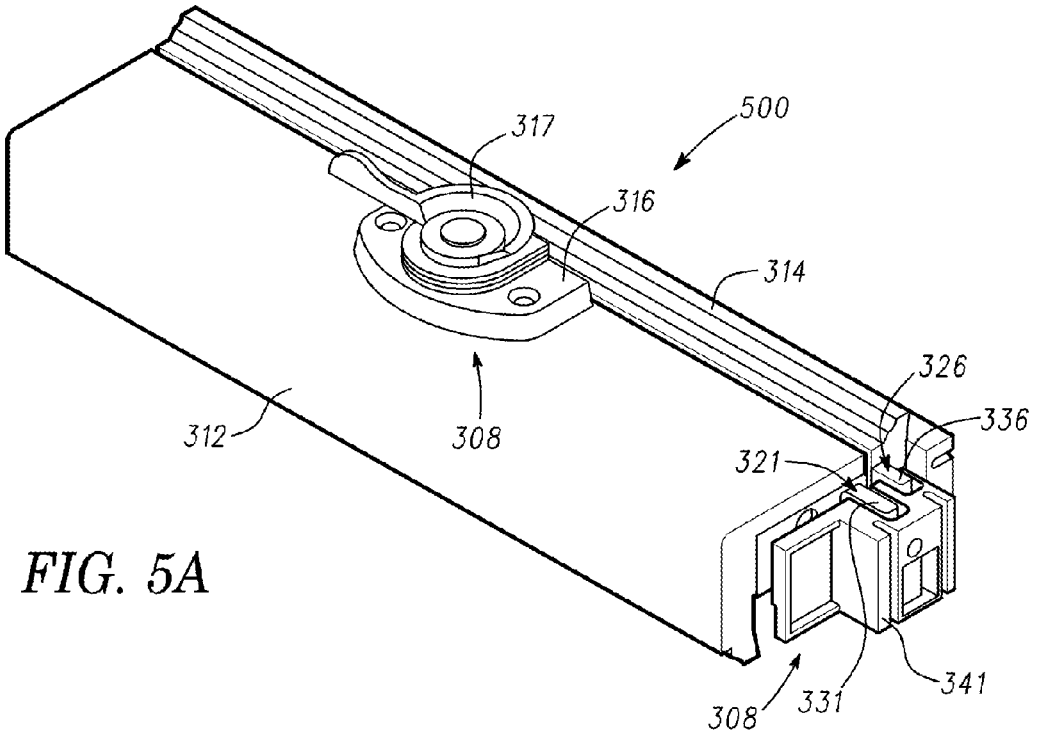
FIG. 5A is a perspective view of one example of top and bottom check rails with a jamb receiver block and latch bolts.

Referring now to FIG. 5A, a perspective view shows one example 500 of the bottom and top check rails 312, 314 of FIGS. 3 and 4, such as corresponding to a fenestration assembly (e.g., the fenestration assembly 100 of FIG. 1). FIG. 5A further shows the bottom latch bolt mechanism 321 with the bottom latch bolt 331 and corresponding bottom check rail 312, and a top latch bolt mechanism 326 with a top latch bolt 336 and corresponding top check rail 314. The bottom and top latch bolts 331, 336 are shown in the example of FIG. 5A in a projected configuration. That is, the bottom and top latch bolts 331, 336, in the projected configuration, extend away from their respective check rails and into respective latch bolt recesses in the first jamb receiver block 341 of a first transmission assembly 501.

Figure 5B:
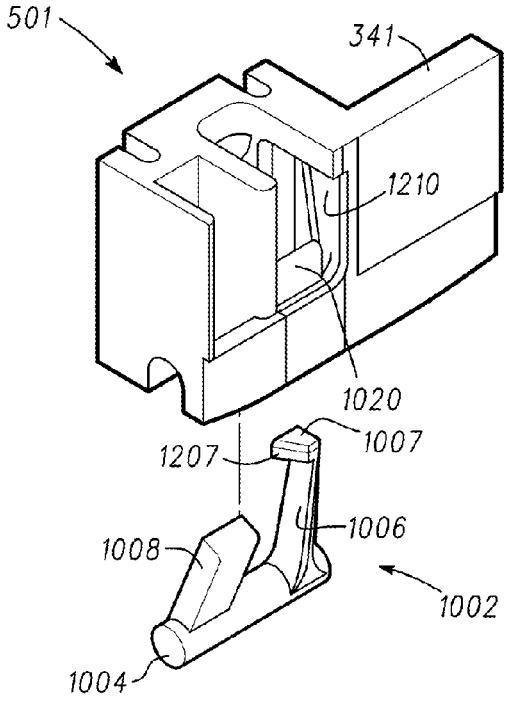
FIG. 5B is a perspective view of one example of a transmission assembly.

The first transmission assembly 501 is shown in an exploded view in FIG. 5B. The first transmission assembly 501 includes the jamb receiver block 341 and a paddle assembly 1002. In an example, the paddle assembly 1002 includes a latch cam 1006, such as having a latch cam extension 1007 protruding therefrom. The paddle assembly 1002 includes a latch follower 1008. In the example of FIG. 5B, the latch cam 1006 and the latch follower 1008 are coupled to a latch pivot member 1004. In an example, the latch cam 1006 is deflectable away from the latch follower 1008. That is, at least the latch cam 1006 portion of the paddle assembly 1002 is made of a material that is sufficiently deformable that the latch cam 1006 can be pushed laterally away from the latch follower 1008. In an example, the receive block 341 includes a stopper protrusion 1020 that is configured to interface with the bottom latch bolt 331.

Referring again to FIG. 5A, the bottom and top latch bolts 331, 336 interface with the paddle assembly 1002 inside the jamb receiver block 341. In an example, the rotatable paddle assembly 1002 rotatably couples the bottom and top latch bolts 331, 336, such that translation of one of the latch bolts can effect a translation of the other using the rotatable paddle assembly 1002.

As further discussed herein, when the bottom and top latch bolts 331, 336 are in the projected configuration shown in FIG. 5A, the corresponding bottom and top sashes (e.g., the bottom and top sashes 304, 306) are restrained from sliding or tilting relative to the fenestration assembly frame (e.g., the frame 302). In an example, the projected configuration shown in FIG. 5A corresponds to a first position of the operator 316. In an example, when movement of the bottom sash 304 is desired, the operator 316 is actuated, for instance, by rotation of the operator interface feature 317, which can remotely move one or both of the bottom and top latch bolts 331, 336 into a withdrawn position (e.g., using the tying element 309). In an example, the frame (e.g., 302) includes recesses or grooves that correspond with the bottom and top latch bolts 331, 336. When the bottom latch bolt 331 is in a withdrawn position (e.g., partially withdrawn toward its housing), the bolt can slide freely within its corresponding recess or groove, thereby permitting the bottom sash 304 to slide within the frame. In an example, the top sash 306 is slidable in the frame when the top latch bolt 336 is in a fully withdrawn position.

In an example, one or both of the bottom and top latch bolts 331, 336 are biased away from their respective housings and away from their respective bottom and top check rails 312, 314, such as using springs, coils, or the like. That is, the bottom and top latch bolts 331, 336 are configured to normally extend away from the sashes and toward the frame 302 of the fenestration assembly, such as when the operator 316 is in a neutral position. In an example, when the operator 316 is in the neutral position and the bottom and top latch bolts 331, 336 are in the projected configuration, the bottom or top sashes 304, 306 lock with corresponding features in the frame 102 at positions, for instance, corresponding to one or more of a closed position (see, e.g., FIG. 1) or a secure venting position (see, e.g., FIG. 2A showing a partially open position).

The operation hardware assembly 308 thereby provides for locking and unlocking of the bottom and top sashes 304, 306 through remote operation of the latch bolts by way of the operator 316. The operation hardware assembly 308 further facilitates an automatic locking configuration wherein as the bottom sash 304 is elevated, for instance, into the configuration shown in FIG. 2A or any intermediate or further elevation, at least the bottom latch bolt 331 is released from a withdrawn configuration and biased toward a projected configuration, and the bottom latch bolt 331 correspondingly seats within a recess in the frame 302 to thereby automatically lock the bottom sash 304 in a closed or partially open position. In another example, the operator 316 is further actuated to correspondingly withdraw at least the bottom latch bolt 331 into the bottom check rail 312 into a fully withdrawn configuration to thereby allow for tilting or removal of the bottom sash 304 relative to the frame 302 (e.g., for maintenance, cleaning of the interior and exterior surfaces, and the like).

Furthermore, the operation hardware assembly 308, in one example, is concealed except for the operator interface feature 317 and a portion of the operator 316 body, such as shown in the example of FIG. 1. For instance, one or more of the bottom latch bolt 331, the bottom latch bolt mechanism 321, the tying element 309, as well as the housing for the bottom latch bolt is concealed within the bottom check rail 312. For instance, the bottom latch bolt 331 and the tying element 309 are fed through interior portions of the bottom check rail 312. In another example, these components are positioned along the periphery of the bottom check rail 312, for instance, at the interface between the bottom check rail 312 and top check rail 314. In the closed position shown in FIG. 1, with this peripheral mounting orientation, the bottom and top check rails 312, 314 conceal much of the operation hardware assembly 308.

Figure 6A:
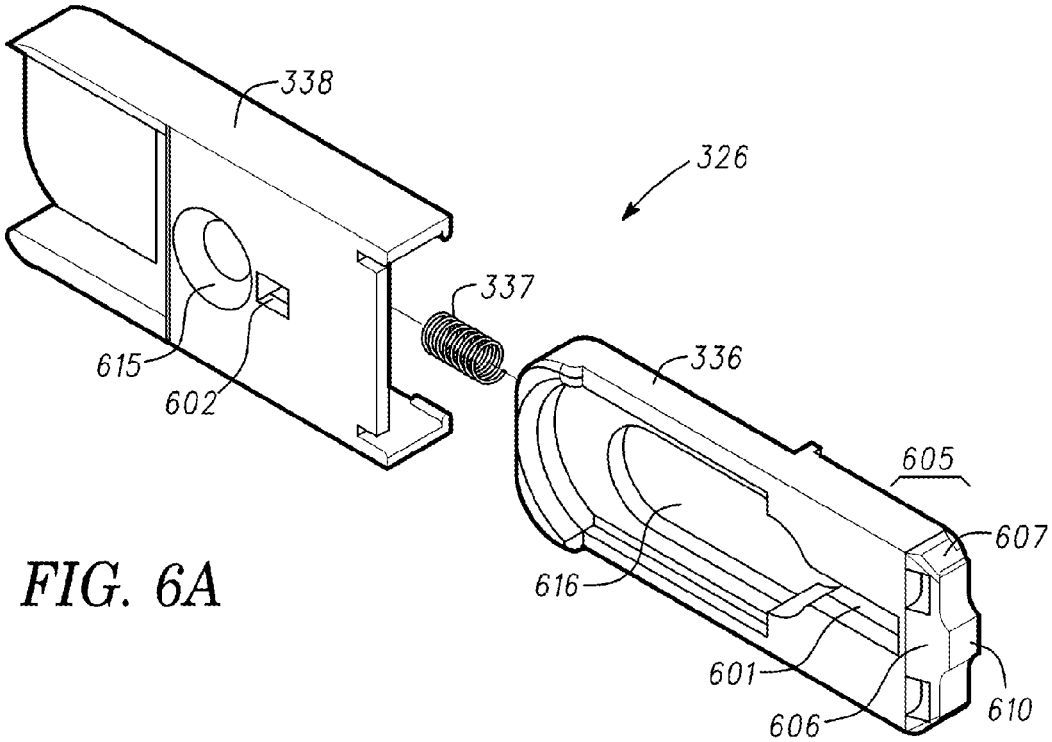
FIG. 6A is an exploded view showing one example of a top latch bolt mechanism.
Figure 6B:
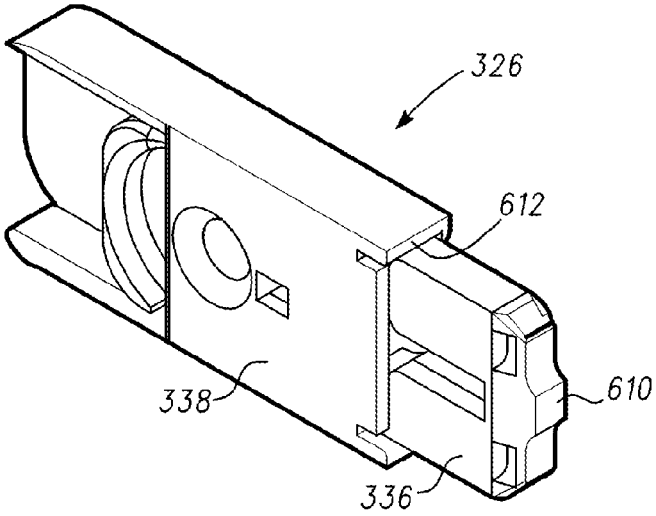
FIG. 6B is a perspective view showing one example of a top latch bolt mechanism in a first configuration.

FIGS. 6A and 6B illustrate the top latch bolt mechanism 326 in exploded (FIG. 6A) and non-exploded (FIG. 6B)

views. Referring first to the exploded view, FIG. 6A shows the top latch bolt mechanism 326, including the top latch bolt 336, a biasing element 337, and a top latch bolt housing 338. The top latch bolt 336 is slidable longitudinally within the top latch bolt housing 338. The biasing element 337 is interposed between a side edge of a biasing element channel 601 on the top latch bolt 336 and a biasing element anchor 602. The biasing element 337 biases the top latch bolt 336 away from the top latch bolt housing 338. In one example, the biasing element 337 includes, but is not limited to, a spring in one of a tension or compression state, or an elastomeric material. In one example, the top latch bolt housing 338 is a metal, plastic, or other material having sufficient strength and durability for installation within a check rail to facilitate the repeated translation of the top latch bolt 336 therein.

In an example, the position of the top latch bolt 336 relative to the top latch bolt housing 338 is continuously variable between projected and withdrawn (e.g., partially or fully withdrawn) configurations. The projected position is illustrated in FIG. 6B. In a fully withdrawn configuration, a paddle engagement face 610 of the top latch bolt 336 is approximately coplanar with a edge face 612 of the top latch bolt housing 338. In an example, when the top latch bolt 336 is in the projected position (FIG. 6B), the corresponding top sash is immobile in its frame. When the top latch bolt 336 is in the fully withdrawn position, the corresponding top sash is slidable in the frame. When the top latch bolt 336 is partially withdrawn, the top sash is immobile in the frame.

In an example, the top latch bolt 336 includes an end portion 605 with several tapered edges, such as on all sides of the top latch bolt 336. For example, a first vertical side 606 is tapered toward the paddle engagement face 610, and a first horizontal side 607 is tapered toward the paddle engagement face 610. The tapered sides of the top latch bolt 336 assist the outwardly biased bolt to align with recesses or grooves in the frame or jamb that are configured to receive the top latch bolt 336. For example, if the top latch bolt 336 is slightly misaligned with a jamb recess, such as because the corresponding top sash 306 is positioned above or below the proper location, or due to tolerances on the sash or jamb, the tapered sides of the top latch bolt 336 can encourage the top sash 306 into position so that the outwardly biased bolt can extend into the recess. Without the tapered edges, the top latch bolt 336 could hang up on an edges of a jamb recess, or the bolt may not fully project into the pocket.

In an example, the top latch bolt 336 further includes a recess 616 configured to receive a guide pin (not shown) or projection 615 of the top latch bolt housing 338. The recess 616 extends along at least a portion of a face of the top latch bolt 336 and receives the projection 615, thereby guiding the top latch bolt 336 during transitions between projected and withdrawn configurations.

In an example, the paddle engagement face 610 cooperates with a latch follower of a paddle assembly, such as the latch follower 1008 shown in FIG. 5B. The paddle engagement face 610 is optionally pushed upon by the latch follower 1008 of the paddle assembly 1002, such as to transmit a rotational movement of the paddle assembly 1002 to the top latch bolt 336.

Figure 7A:
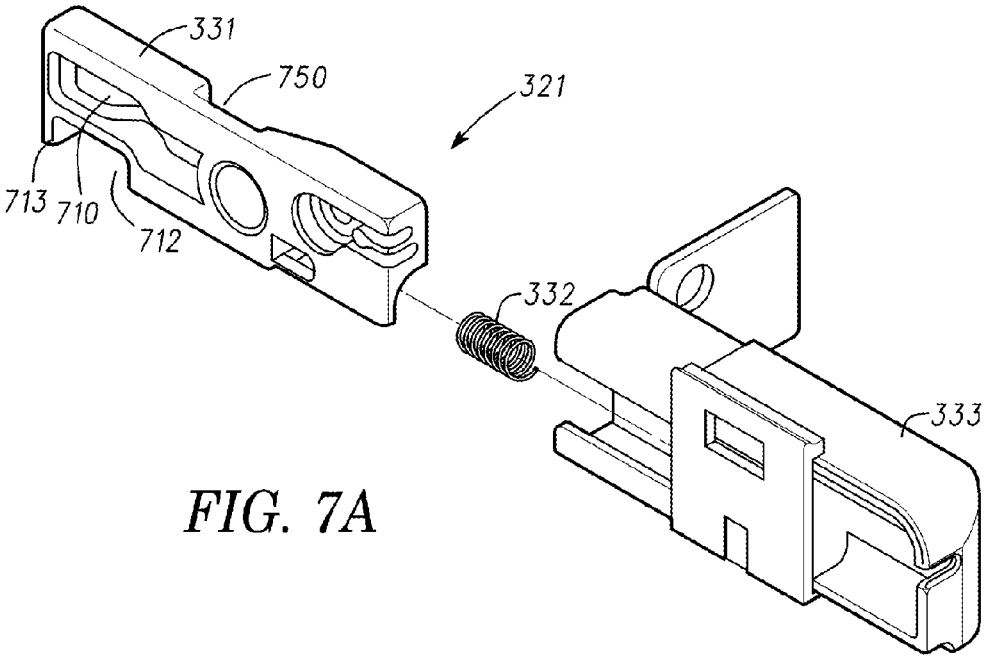
FIG. 7A is an exploded view showing one example of a bottom latch bolt mechanism.
Figure 7B:
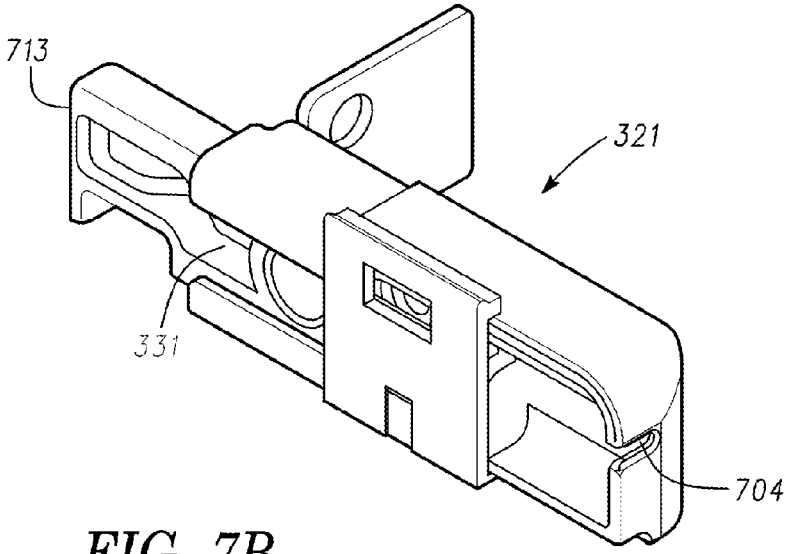
FIG. 7B is a perspective view showing one example of a bottom latch bolt mechanism.
Figure 7C:
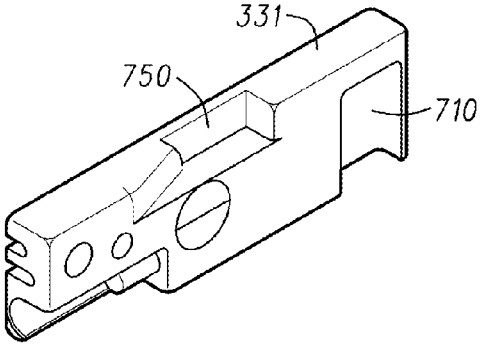
FIG. 7C is a perspective view showing one example of a bottom latch bolt.

FIGS. 7A and 7B illustrate the bottom latch bolt mechanism 321 in exploded (FIG. 7A) and non-exploded (FIG. 7B) views. FIG. 7C illustrates a perspective view of the bottom latch bolt 331. Referring first to the exploded view, FIG. 7A shows the bottom latch bolt mechanism 321, including the bottom latch bolt 331, a biasing element 332, and a bottom latch bolt housing 333. The bottom latch bolt 331 is slidable within the bottom latch bolt housing 333, and the biasing element 332 biases the bottom latch bolt 331 away from the bottom latch bolt housing 333 toward a projected position (e.g., shown in FIG. 7B). In one example, the biasing element 332 includes, but is not limited to, a coil spring in one of a tension or compression state or an elastomeric material. In one example, the bottom latch bolt housing 333 is a metal, plastic, or other material having sufficient strength and durability for installation within a check rail to facilitate the repeated translation of the bottom latch bolt 331 therein.

The biasing element 332 extends between the bottom latch bolt housing 333 and a corresponding portion of the bottom latch bolt 331. The latch bolt biasing element 332 is configured to bias the bottom latch bolt 331 into a projected position, for instance, where the bottom latch bolt 331 is received within a corresponding recess provided in the frame 302 to secure the bottom sash 304 in position. In another example, the bottom latch bolt mechanism 321 includes a tying element orifice 704 sized and shaped to receive the tying element 309 therethrough and to facilitate the sliding movement of the tying element relative to the bottom latch bolt mechanism 321. As shown in the example of FIG. 4, the tying element 309 is coupled with the bottom latch bolt 331. Tensioning the tying element 309, for instance by rotation of the operator interface feature 317, withdraws the bottom latch bolt 331 into the bottom latch bolt housing 333 to thereby facilitate one or more of a sliding or tilting movement of the sash 304 relative to the frame 302.

In an example, FIG. 7C shows the bottom latch bolt 331 includes a paddle cam recess 710. As further described below, the paddle cam recess 710 is a recessed face of the bottom latch bolt 331 that receives a paddle arm, or cam, of a paddle assembly. For example, the paddle cam recess 710 is configured to receive the latch cam 1006 of the paddle assembly 1002 shown in FIG. 5B. When the paddle cam recess 710 translates with translation of the bottom latch bolt 331 between the projected and withdrawn configurations, the paddle arm is similarly caused to translate, or rotate, such as about the paddle pivot member 1004 (see, e.g., FIGS. 5B and 10). In an example, translation or rotation of the latch cam 1006 is further translated to the latch follower 1008 of the paddle assembly 1002 to actuate the top latch bolt 336 (e.g., to bias the top latch bolt 336 toward a withdrawn position).

Referring again to FIG. 7B, the bottom latch bolt 331 includes a retention recess 712 that includes an open, undercut area along a bottom portion of the bottom latch bolt 331. The retention recess 712 is bounded by the bottom latch bolt 331 body and a recess lip 713. As further described below, the retention recess 712 is configured to cooperate with the stopper protrusion 1020 on the jamb receiver block 341. The stopper protrusion acts as a dead stop to prevent damage to the latch cam 1006, such as can occur if the bottom latch bolt 331 is forced into a fully withdrawn position without first translating the bottom sash 304 upward, because the latch cam extension 1007 is optionally retained in the paddle cam recess 710.

In an example, when the bottom sash 304 is in the fully closed position (see, e.g., FIG. 1) and the bottom latch bolt 331 is in the fully projected position and received in the jamb receiver block 341, the retention recess 712 is disposed about the stopper protrusion 1020. In this configuration, even under tension provided by the operator 316 and the tying element 309, the recess lip 713 impinges on the stopper protrusion and the bottom latch bolt 331 is precluded from reaching a fully withdrawn configuration. In other words, when the bottom sash 304 is fully closed, the bottom latch bolt 331 cannot be fully withdrawn into the bottom latch bolt housing 333. In an example, as further described below, when the bottom latch bolt 331 is partially withdrawn (e.g., by actuation of the operator 316 and the tying element 309), the bottom sash 304 can be lifted upward out of the fully closed configuration. When the bottom sash 304 is lifted by an amount that exceeds a height of the lip 713, the bottom latch bolt 331 can be fully withdrawn into the bottom latch bolt housing 333, such as using the operator 316. In the fully withdrawn configuration, the bottom sash 304 can be tilted (see, e.g., FIG. 2B).

Figure 8A:
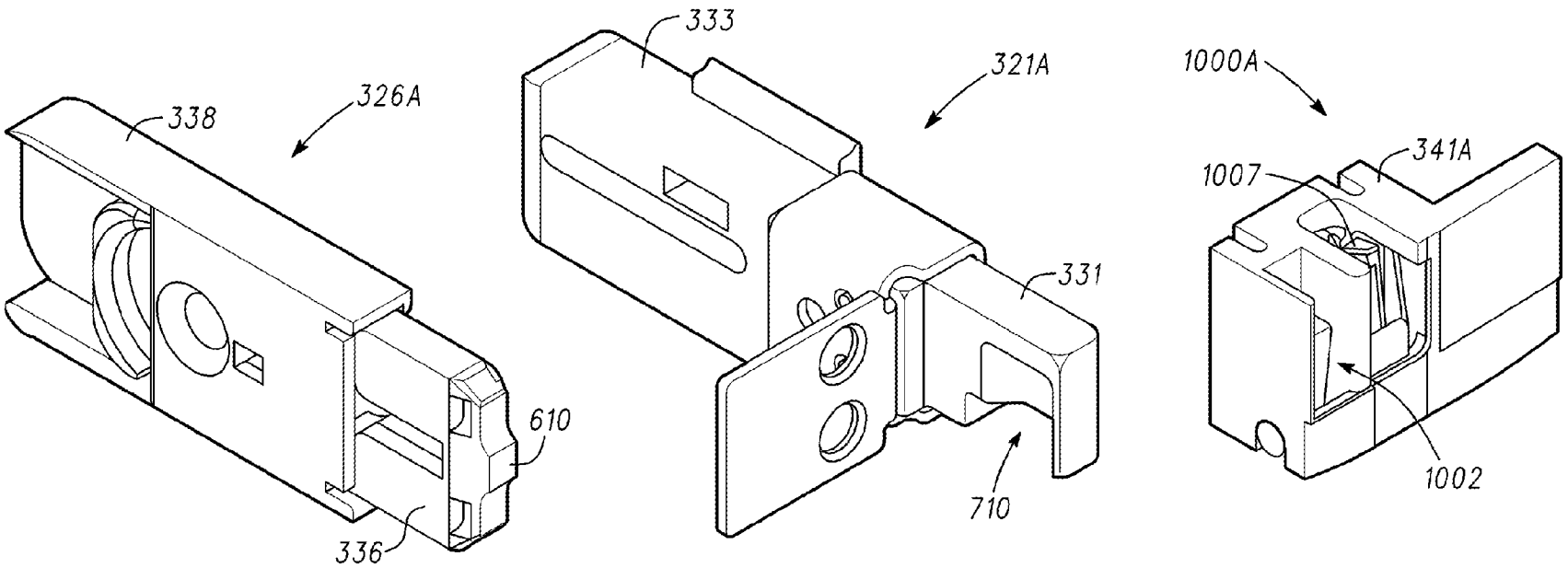
FIG. 8A is a perspective view showing top and bottom latch mechanisms in projected positions with a transmission assembly in a corresponding configuration.
Figure 8B:
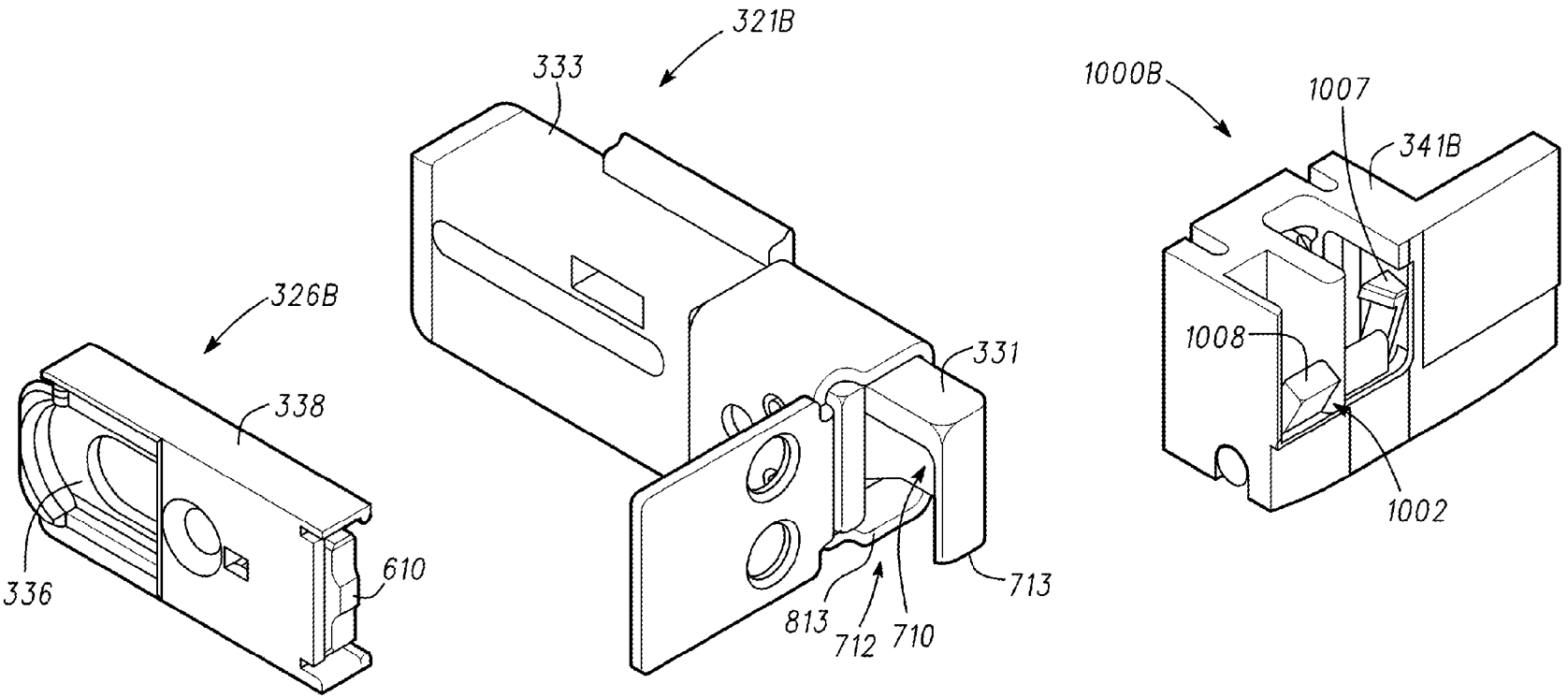
FIG. 8B is a perspective view showing the top and bottom latch mechanisms in withdrawn positions with a transmission assembly in a corresponding configuration.
Figure 8C:
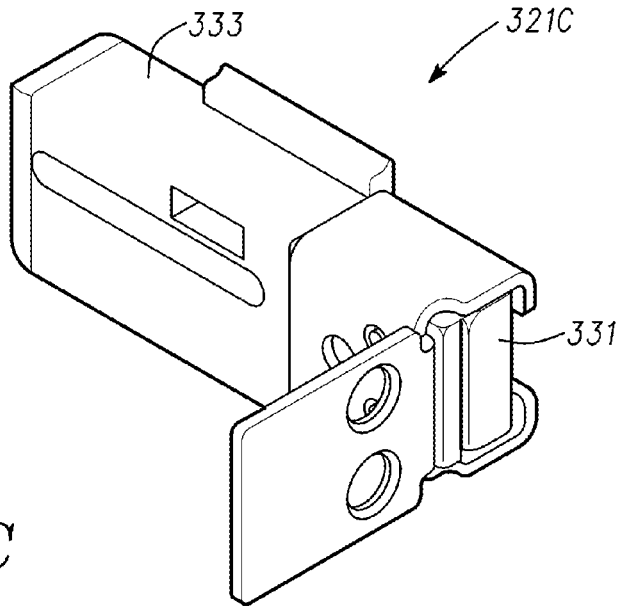
FIG. 8C is a perspective view showing the bottom latch mechanisms in a withdrawn position.
Figure 9:
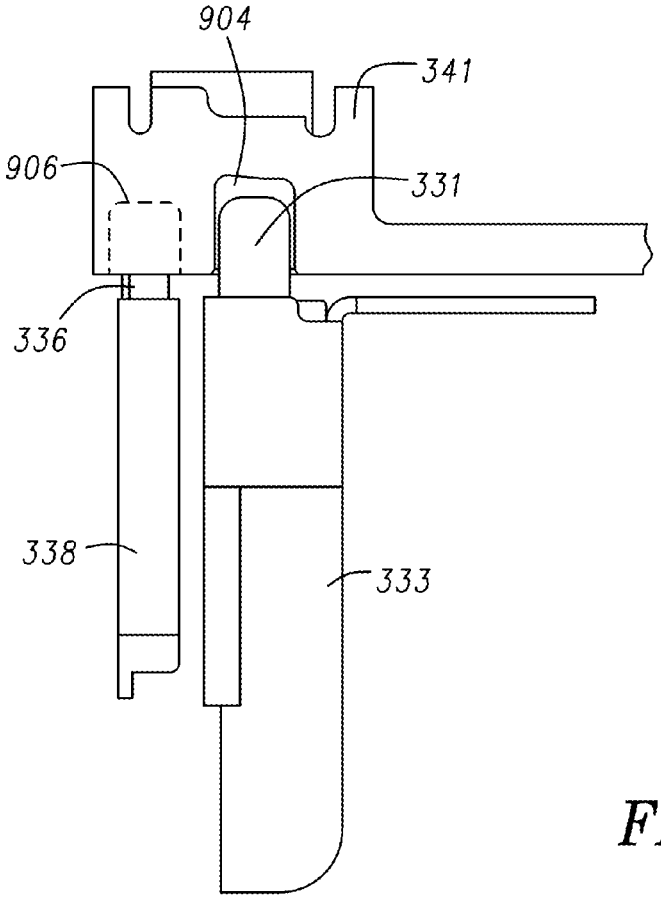
FIG. 9 is a top view showing an example of a jamb receiver block with bottom and top latch bolt mechanisms.

FIGS. 8A and 8B illustrate examples of each of the bottom and top latch mechanisms 321, 326 and transmission assemblies in respective projected and first withdrawn configurations. FIG. 8C illustrates an example of the bottom latch mechanism 321 in a second withdrawn configuration. Referring first to FIG. 8A, a projected bottom latch mechanism 321A and a projected top latch mechanism 326A are shown with a transmission assembly 1000A. The projected configuration corresponds to a first configuration of the transmission assembly 1000A that includes the paddle assembly 1002 in a first position wherein the latch cam extension 1007 is positionable within the paddle cam recess 710 of the bottom latch bolt 331, and the paddle engagement face 610 of the top latch bolt 336 is engaged with the latch follower 1008 of the paddle assembly 1002. Referring to FIG. 9, a top view shows the jamb receiver block 341 and the projected bottom and top latch mechanisms 321C, 326C. In the example of FIG. 9, the bottom and top latch bolts 331, 336 are in their respective projected configurations, such as corresponding to the examples 321A and 326A of FIG. 8A. As shown in FIG. 9, the bottom latch bolt 331 extends into a bottom latch bolt recess 904 in the jamb receiver block 341, and the top latch bolt 336 extends into a top latch bolt recess 906. Referring again to FIG. 8A, a jamb receiver block 341A is shown, including the paddle assembly 1002 rotated into a position that corresponds to the projected bottom and top latch mechanisms 321A and 326A.

In FIG. 8B, a first withdrawn bottom latch mechanism 321B and a withdrawn top latch mechanism 326B are shown. In this example, the first withdrawn configuration for the bottom latch mechanism 321B corresponds to a position of the paddle assembly wherein the latch cam extension 1007 is positioned within the paddle cam recess 710 of the bottom latch bolt 331, and the paddle engagement face 610 of the top latch bolt 336 is engaged with the latch follower 1008 of the paddle assembly. In an example that includes the bottom sash 304 in a fully closed configuration (see, e.g., FIG. 1), the stopper protrusion of the jamb receiver block is positioned between the recess lip 713 and a bottom edge portion 813 of the bottom latch bolt housing 333. In this example, the bottom latch bolt 331 is precluded from further withdrawing into the bottom latch bolt housing 333 by the stopper protrusion and the recess lip 713.

In an example that includes the bottom sash 304 in an open configuration, for example, wherein the stopper protrusion does not extend into the retention recess 712, the bottom latch bolt 331 can be optionally further withdrawn into the bottom latch bolt housing 333. FIG. 8B includes the jamb receiver block 341B, which includes the paddle assembly 1002 rotated into a position that corresponds to the first withdrawn bottom latch mechanism 321B and the withdrawn top latch mechanism 326B.

FIG. 8C shows a second withdrawn bottom latch mechanism 321C. In this example, the second withdrawn configuration corresponds to an elevated bottom sash 304. When the bottom sash 304 is sufficiently elevated, such as by an amount greater than a height of the stopper protrusion in the jamb receiver block 341, the latch cam extension 1007 of the paddle assembly 1002 is decoupled from the paddle cam recess 710 of the bottom latch bolt 331, and the paddle engagement face 610 of the top latch bolt 336 is optionally engaged with the latch follower 1008 of the paddle assembly 1002. In the second withdrawn configuration, the bottom sash 304 is slidable in the frame 302, and the bottom sash 304 is tiltable away from the frame 302 (see, e.g., FIG. 2B). In the second withdrawn configuration, the bottom latch bolt 331 is not seated in any grooves or channels provided in the frame 302, and the bottom sash 304 is thereby not guided by such grooves or channels.

FIG. 10 is a perspective view showing an example of a transmission assembly 1000 that includes the jamb receiver block 341 and a jamb paddle assembly 1002. In an example, the jamb receiver block 341 is operatively coupled with the jamb paddle assembly 1002 to form the transmission assembly 1000, and the transmission assembly 1000 is configured to transmit movement, for instance, translational movement of the bottom latch bolt 331 to the top latch bolt 336. In the example shown, the transmission assembly 1000 is sized and shaped for installation within the frame 302. In the example of FIG. 10, the paddle assembly 1002 includes a paddle pivot member 1004 rotatably coupled with the jamb receiver block 1001 to facilitate rotation of the paddle assembly 1002. The paddle assembly 1002 includes a latch cam 1006 coupled with the paddle pivot member 1004 at one end, and having a cam extension 1007 at an opposite end. Similarly, the paddle assembly 1002 includes a latch follower 1008 coupled with the paddle pivot member 1004.

The arrangement shown in FIG. 10 allows for the transmission of movement from the bottom latch bolt 331 (see, e.g., FIGS. 7A and 7B) to the top latch bolt 336 (see, e.g., FIGS. 6A and 6B), for instance, through rotation of the paddle assembly 1002. Each of the latch cam 1006 and the latch follower 1008 are positioned in corresponding bolt recess 904, 906. In an example, rotation of the latch cam 1006 is transmitted to the latch follower 1008, for instance, by the paddle pivot member 1004.

In an example, in operation, as the bottom latch bolt 331 is drawn into the bottom latch bolt housing 333 (e.g., by operation of the fenestration operation hardware assembly 308), the latch cam extension 1007 is received within the paddle cam recess 710 to rotate the paddle assembly 1002 about the paddle pivot member 1004. As the paddle assembly 1002 is rotatably driven by the bottom latch bolt 331 by way of the latch cam 1006 and the latch cam extension 1007, the latch follower 1008 similarly rotates. Accordingly, the latch follower 1008 can impinge upon and exert a force upon the top latch bolt 336, such as at the paddle engagement face 610, and the top latch bolt 336 is pushed away from its projected configuration toward a withdrawn configuration. The bottom latch bolt 331 moves out of the bottom latch bolt recess 904 and accordingly allows for slidable movement of the bottom sash 304 relative to the frame 302. In an example, the jamb receiver block 341 includes a stopper protrusion 1020 that prevents the bottom latch bolt 331 from fully withdrawing from the bottom latch bolt recess 904 by engaging with the retention recess 712 of the bottom latch bolt 331, such as described above in the discussion of FIG. 8B.

In an example, rotational movement of the paddle assembly 1002 is transmitted along the paddle pivot member 1004, for instance, to the latch follower 1008. The latch follower

1008, as mentioned above, is engaged with the paddle engagement face 610, and rotational movement of the latch follower 1008 is thereby transmitted to the paddle engagement face 610 and accordingly biases the top latch bolt 336 into the top latch bolt housing 338. Accordingly, as the bottom latch bolt 331 is withdrawn, the top latch bolt 336 similarly withdraws into its respective housing by way of operation of the paddle assembly 1002. As long as the top latch bolt 336 and the latch follower 1008 are engaged, and the bottom sash 304 is in the closed configuration (see, e.g., FIG. 1), translational movement of the bottom latch bolt 331 into or out of its housing translates to similar movement of the top latch bolt 336 by way of the paddle assembly 1002.

In an example, when either the bottom latch bolt 331 or the top latch bolt 336 is disengaged from the paddle assembly 1002, the other of the latch bolts is no longer operably biased by the paddle assembly 1002. For instance, in the bottom sash 304 is first moved upwardly relative to the paddle assembly 1002 and the jamb receiver block 341, the bottom sash bolt 331 loses engagement with the latch cam 1006 and the latch cam extension 1007. That is, the latch cam extension 1007 disengages from the paddle recess 710, and the bias in the top latch bolt 336 (e.g., provided by the biasing element 337) biases the top latch bolt 336 toward the projected position. Accordingly, if opening of both the bottom and top sashes 304, 306 is desired, the top sash 306 is moved first while the bottom sash bolt 331 is in the withdrawn position, such as provided by withdrawal of the bottom latch bolt 331 and corresponding rotation of the paddle assembly 1002.

In an example, moving the top sash 306, for instance, lowering the top sash 306, disengages the top latch bolt 336 from the paddle assembly 1002. However, this disengagement does not result in an automatic locking of the top latch bolt 336; instead the depression of the top sash 306 allows the previously withdrawn top latch bolt 336 to ride within a guide channel of the frame 302 or against a rail of the frame 302, and accordingly continue its downward movement. Upon receiving the top sash 306 at a position where the top latch bolt 336 projects into the top latch bolt recess 906, the top latch bolt 336 may lock according to the relative position of the paddle assembly 1002, such as dictated by the bottom latch bolt 331. Accordingly, the fenestration operation hardware assembly 308, through cooperation of the bottom and top latch bolts 331, 336, controls an opening, closing, or locking of the bottom and top sashes 304, 306, such as using the operator interface feature 317 to remotely actuate a bottom latch bolt 331.

Figure 11:
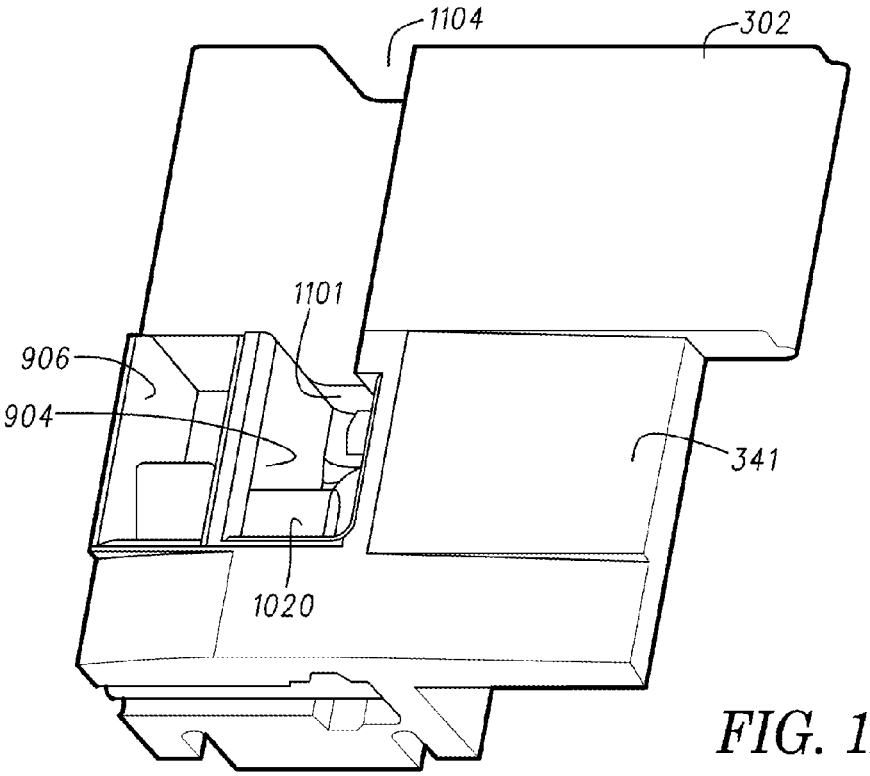
FIG. 11 is a perspective view of a jamb receiver block, jamb paddle assembly, and a portion of an upper frame.

FIG. 11 is a perspective view of the jamb receiver block 341 with a portion of the frame 302. In an example, the frame 302 includes a bottom latch bolt frame channel positioned above the bottom latch bolt recess 904 in the jamb receiver block 341. In an example, the bottom latch bolt frame channel 1104 is not as deep as the bottom latch bolt recess 904. That is, the bottom latch bolt recess 904 extends away from the bottom check rail 112 by a first amount that is greater than the amount the bottom latch bolt frame channel extends away from the bottom check rail 112 when the bottom check rail is adjacent to the portion of the frame that includes the bottom latch bolt frame channel 1104 or the jamb receiver block 341. In an example, the difference in depth results in an overhang 1101 that extends above a portion of the bottom latch bolt recess 904. In operation, when the bottom latch bolt 331 is in the projected configuration (see, e.g., FIG. 8A), the bottom sash 304, which is coupled to the bottom latch bolt 331, is immobilized because the bottom latch bolt 331 is secured between the overhang 1101 and the lower portion of the jamb receiver block 341. However, when the bottom latch bolt 331 is in the first withdrawn configuration (see, e.g., FIG. 8B) the bottom latch bolt 331 can slide upwardly through the bottom latch bolt frame channel 1104. As described above, the bottom latch bolt 331 is prevented, by the stopper protrusion 1020 on the jamb receiver block 341, from attaining its fully withdrawn configuration when the bottom sash 304 is in the fully closed configuration.

In an example, the bottom latch bolt 331 is biased outwardly toward its projected configuration from the bottom latch bolt housing 333. Accordingly, when the bottom sash 304 is slid or tilted from an open position to the fully closed position, the bottom latch bolt 331 can align with the bottom latch bolt recess 904 in the jamb receiver block 341, and the bottom latch bolt 331 can forcibly extend into the bottom latch bolt recess 904. A front edge of the bottom latch bolt 331 can impinge upon the latch cam 1006 and the latch cam extension 1007, such as at an angled face 1207 of the latch cam extension 1007 (see, e.g., FIG. 5B). In an example, under the force of the biasing element 332, the bottom latch bolt 331 can deflect the latch cam 1006 away from the latch follower 1008. In an example, the jamb receiver block 341 includes a cam recess 1210 (see, e.g., FIG. 5B) that is configured to provide adequate clearance for the latch cam 1006 to deflect around the front edge of the bottom latch bolt 331 as the bottom latch bolt 331 is forced by the biasing element 332 into the bottom latch bolt recess 904. Accordingly, the latch cam 1006 enables the paddle assembly 1002 to reset into a static state when the bottom latch bolt 331 is forcibly returned to the bottom latch bolt recess 904, such as without actuating the top latch bolt 336.

Figure 12:
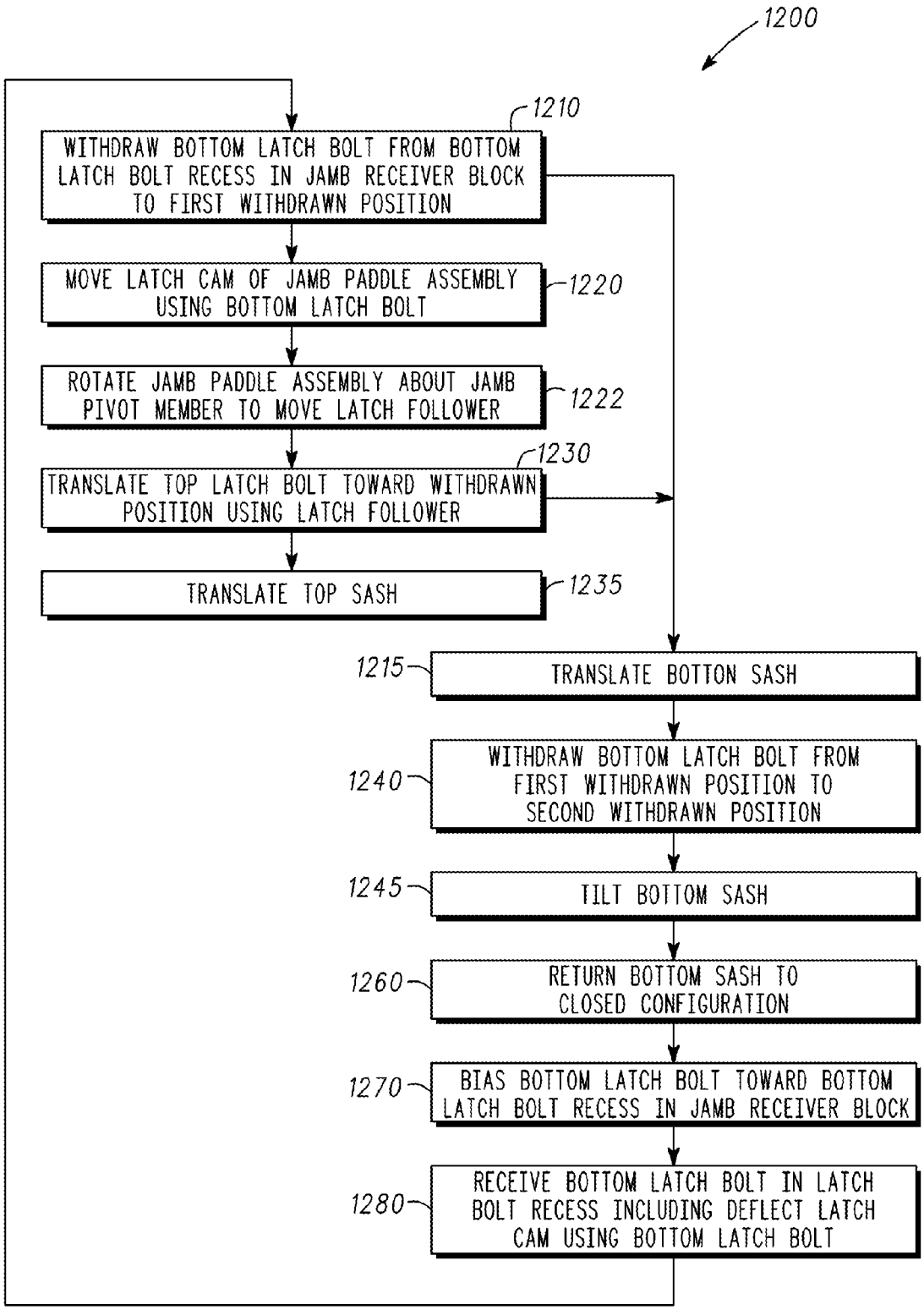
FIG. 12 is a block diagram illustrating a method of using bottom and top latch mechanisms with a transmission assembly.

FIG. 12 illustrates an example of a method 1200 that can include using the fenestration operation hardware assembly 308 described above. In an example, in an initial configuration, the fenestration assembly 100 is in the closed configuration shown in FIG. 1. In this configuration, the bottom and top latch bolts 331, 336 are biased away from the respective bottom and top check rails 312, 314 and into the respective bottom and top latch bolt recesses 904, 906 in the jamb receiver block 341. At 1210, the bottom latch bolt 331 can be withdrawn into the bottom latch bolt housing 333. For example, actuation of the operator interface feature 317 causes the operator 316 to withdraw the bottom latch bolt 331 into the bottom sash 304, such as by way of the tying element 309. In an example, at 1210, the bottom latch bolt 331 is withdrawn to a first withdrawn position that is less than a fully withdrawn position (see, e.g., the discussion below at 1240), such as is available when the bottom latch bolt 331 is positioned in an at least partially translated configuration, as described below. In an example, the first withdrawn position corresponds to FIG. 8B wherein the jamb paddle assembly 1002 is partially rotated, the bottom sash 304 is translatable upward relative to the frame 302, and the bottom latch bolt 331 is prohibited from further withdrawing from the bottom latch bolt recess 904 because the stopper protrusion 1020 engages with the retention recess 712 on the bottom latch bolt 331. At 1215, the bottom sash 304 is optionally translated upward relative to the frame 302.

At 1220, the latch cam 1006 is moved by the translation of the bottom latch bolt 331. For example, the latch cam 1006 includes the latch cam extension 1007, and the latch cam extension 1007 engages with the paddle cam recess 710 in the bottom latch bolt 331. As the bottom latch bolt 331 is withdrawn at 1210, the latch cam extension 1007 is received in and moved by translation of the paddle cam recess 710.

Movement of the latch cam extension 1007 is translated by the latch cam 1006 to rotation of the paddle pivot member 1004 of the jamb paddle assembly 1002. At 1222, the jamb paddle assembly 1002 rotates about the paddle pivot member 1004 axis and, in turn, moves the latch follower 1008. For example, the latch follower 1008 moves toward the top check rail 314.

At 1230, movement of the latch follower 1008 toward the top check rail 314 translates the top latch bolt 336 toward a withdrawn position. The top latch bolt 336 is normally biased outwardly away from the top check rail 314 and into the top latch bolt recess 906. However, when the latch follower 1008 is rotated by way of movement of the latch cam 1006, the latch follower 1008 impinges on the paddle engagement face 610 of the top latch bolt 336 and translates the top latch bolt 336 into the top latch bolt housing 338.

In an example, the jamb paddle assembly 1002 is rotated at 1222 such that the latch follower 1008 translates the top latch bolt 336 to a sufficiently withdrawn position such that the paddle engagement face 610 is translated beyond a jamb face 1015 of the jamb receiver block 341. In this configuration, the top latch bolt 336 is disengaged from the top latch bolt recess 906 and the top sash 306 can be translated at 1235.

In an example, when the top sash 306 is returned from a translated configuration to the closed configuration (i.e., when the top sash 306 is positioned in a fully elevated configuration, such as shown by the top sash 106 in the example of FIG. 1), the outwardly biased top latch bolt 336 automatically extends into the top latch bolt recess 906. Accordingly, if opening of the bottom and top sashes 304, 306 is desired, the top sash 306 is moved first. For instance, if the bottom sash 304 is moved first, the latch cam 1006 disengages from the paddle cam recess 710, and the paddle assembly 1002 rotates in response to the outward bias of the top latch bolt 336 (i.e., the only force acting on the paddle assembly 1002 when the bottom latch bolt 331 is disengaged from the bottom latch bolt recess 904).

In an example, when the top latch bolt 336 extends into the top latch bolt recess 906, the paddle engagement face 610 reengages with the latch follower 1008 and thereby rotates the paddle assembly 1002 toward the locked configuration shown in FIG. 8A. That is when the top latch bolt 336 is fully extended into the top latch bolt recess 906, the paddle assembly 1002 is rotated about the paddle pivot member 1004, and the latch cam 1006 is similarly rotated to the locked configuration. In this configuration, if the bottom sash 304 is in a translated configuration, the bottom sash 304 can freely translate downward toward the closed configuration. The paddle cam recess 710 receives the latch cam extension 1007 as the bottom sash 304 translates downward into the closed configuration. In an example, if the bottom latch bolt is in a withdrawn position and is released from the withdrawn position when the top latch bolt 336 is already engaged with the latch follower 1008 and the latch follower 1008 is fully biased (rotated) toward the locked position by the top latch bolt 336, the bottom latch bolt 331 can extend into the bottom latch bolt recess 904 by impinging on the latch cam extension 1007 (e.g., by impinging on a slanted face of the latch cam extension 1007) and deflecting the latch cam 1006 such that the bottom latch bolt 331 can fully extend into the bottom latch bolt recess 904.

At 1215, the bottom sash 304 is translated upward, such as shown in the example of FIG. 2A. In an example, the bottom sash 304 is translated upward by a distance that is at least as far as the height of the stopper protrusion 1020. Once the recess lip 713 of the bottom latch bolt 331 is positioned above the stopper protrusion 1020 due to translation of the bottom sash 304, the bottom latch bolt 331 can be further withdrawn into the bottom latch bolt housing 333, such as using the operator 116.

At 1240, when the bottom sash 304 is in the translated configuration, the bottom latch bolt 331 is further withdrawn into the latch bolt housing 333 from the first withdrawn position to a second withdrawn position, such as a fully withdrawn position (see, e.g., FIG. 8C at 321C). In an example, the bottom latch bolt 331 is withdrawn to the second withdrawn position by actuation of the operator 316 (e.g., by rotating the operator interface feature 317) to enter a tilt mode. Because the bottom sash 304 is translated, or elevated, the recess lip 713 does not impinge on the stopper protrusion 1020 when the bottom latch bolt 331 is withdrawn to the second withdrawn position.

In an example, when the bottom latch bolt 331 is in the second withdrawn position, a tilt release trigger engages with the tilt groove 750 on the bottom latch bolt 331, such as when the bottom latch bolt 331 reaches the second withdrawn position. The tilt release trigger locks the bottom latch bolt 331 in the second withdrawn position through engagement of a tilt retention feature of the tilt release trigger against the corresponding tilt groove 750. The engagement between the tilt retention feature and the tilt groove 750 locks the bottom latch bolt 331 in the second withdrawn position to permit tilting of the bottom sash 304, such as without continued actuation of the operator 316. That is, the tilt retention feature biases the bottom latch bolt 331 into the second withdrawn configuration (e.g., FIG. 8C at 321C) against the bias of the biasing element 332. In this configuration, the bottom sash 304 is tiltable away from the frame 302. At 1245, the bottom sash 304 is tilted.

At 1260, the bottom sash 304 is returned to a non-tilted configuration. In an example, the bottom sash 304 is returned from a tilted configuration to a translated configuration that corresponds to an at least partially open configuration (see, e.g., FIG. 2A). In this example, the bottom sash 304 can be translated downward into the fully closed configuration to reseat the bottom latch bolt 331 in the bottom latch bolt recess 904. For example, at 1270, the bottom latch bolt 331 can be biased toward the bottom latch bolt recess 904 by the biasing element 332, such as upon release of the tilt retention feature. In an example, the tilt retention feature is automatically released when the bottom sash 304 is translated downward into the fully closed configuration. At 1280, the bottom latch bolt 331 can be received in the latch bolt recess 904, such as by deflecting the latch cam 1006 away from the latch follower 1008 of the paddle assembly 1002.

In an example, a tilt release trigger automatically releases the tilt retention feature such that the bottom latch bolt 331 can extend into the bottom latch bolt recess 904. In another example, the bottom sash 304 is returned from the tilted configuration to a fully closed configuration (see, e.g., FIG. 1). In this example, the bottom latch bolt 331 reengages with the bottom latch bolt recess 904, such as automatically upon release of the tilt retention feature when the bottom latch bolt 331 is returned to the upright position.

EXAMPLES & ADDITIONAL NOTES

Example 1 can include or use subject matter (such as an apparatus or a method), such as can include or use a fenestration operation hardware assembly including a jamb paddle configured for coupling with a frame. In Example 1, the jamb paddle includes a pivot, a latch cam coupled with the pivot, and a latch follower coupled with the pivot. In Example 1, the fenestration operation hardware assembly includes a first latch mechanism configured for coupling with a bottom sash slidable within the frame, and the first latch mechanism includes a bottom latch bolt movable between first and second positions, and the bottom latch bolt selectively engages the latch cam, and a second latch mechanism configured for coupling with a top sash slidable within the frame, the second latch mechanism includes a top latch bolt movable between first and second positions, in the first position the top sash is movable relative to the frame and in the second position the top sash is immobile, and the top latch bolt selectively engages the latch follower.

Example 2 can include, or can optionally be combined with the subject matter of Example 1, to optionally include the first latch bolt, wherein when the first latch bolt is in the withdrawn position, it biases the latch follower and the latch cam in the direction of the first latch bolt.

Example 3 can include, or can optionally be combined with the subject matter of one or any combination of Examples 1 or 2 to optionally include the jamb paddle, wherein the jamb paddle is configured to transmit a force from the latch cam to the latch follower according to withdrawal of the bottom latch bolt to the first position, and the latch follower biases the top latch bolt toward the first position according to the transmitted force.

Example 4 can include, or can optionally be combined with the subject matter of one or any combination of Examples 1 through 3 to optionally include wherein the first position includes a first withdrawn position and a second withdrawn position, and the bottom latch bolt is movable between the second, first withdrawn, and second withdrawn positions, and in the first withdrawn position, the bottom sash is movable relative to a plane of the frame.

Example 5 can include, or can optionally be combined with the subject matter of one or any combination of Examples 1 through 4 to optionally include, when the bottom latch bolt is in a fully withdrawn position, the bottom sash is tiltable away from the plane of the frame.

Example 6 can include, or can optionally be combined with the subject matter of one or any combination of Examples 1 through 5 to optionally include the latch cam is received in a recess of the bottom latch bolt and the latch cam precludes the bottom latch bolt from occupying a fully withdrawn position when the bottom sash is in a closed configuration.

Example 7 can include, or can optionally be combined with the subject matter of one or any combination of Examples 1 through 6 to optionally include the bottom latch bolt disengages from the latch cam when the bottom sash translates away from the closed configuration by a predetermined amount.

Example 8 can include, or can optionally be combined with the subject matter of one or any combination of Examples 1 through 7 to optionally include an operator remote from the first and second latch mechanisms, the operator engaged with at least one of the first and second latch mechanisms by a tying element, and the operator includes a movable operator interface feature configured to move the at least one of the first and second latch mechanisms between the withdrawn and projected positions.

Example 9 can include, or can optionally be combined with the subject matter of one or any combination of Examples 1 through 8 to optionally include an operator remote from the first and second latch mechanisms, the operator engaged with the jamb paddle by a tying element, and the operator including a movable operator interface feature configured to rotate the jamb paddle about the pivot to toggle at least one of the first and second latch mechanisms between the first and second positions.

Example 10 can include, or can optionally be combined with the subject matter of one or any combination of Examples 1 through 9 to optionally the bottom and top latch bolts are biased toward the respective second positions, such as including positions that correspond to the latch bolts extending away from their respective sashes.

Example 11 can include, or can optionally be combined with the subject matter of one or any combination of Examples 1 through 10 to include subject matter (such as an apparatus, or a method), such as can include a fenestration operation hardware assembly, including a jamb receiver block configured for reception within a frame, and a jamb paddle assembly, movingly coupled with the jamb receiver block or the frame. In Example 11, the jamb paddle assembly includes a latch cam including a deflectable arm, the latch cam configured to engage with a first latch bolt, a latch follower configured to engage with a second latch bolt, and a pivot member coupling the latch follower and the latch cam, wherein movement of the first latch bolt is transmitted to the second latch bolt through the jamb paddle assembly.

Example 12 can include, or can optionally be combined with the subject matter of Example 11, to optionally include the jamb paddle assembly is rotatably coupled with the jamb receiver block or the frame, and the jamb paddle is rotatable about the pivot member.

Example 13 can include, or can optionally be combined with the subject matter of one or any combination of Examples 11 or 12 to optionally include the deflectable arm includes a projection configured to engage with a detent in the first latch bolt.

Example 14 can include, or can optionally be combined with the subject matter of one or any combination of Examples 11 through 13 to optionally include the deflectable arm configured to flex laterally away from the first latch bolt.

Example 15 can include, or can optionally be combined with the subject matter of one or any combination of Examples 11 through 14 to optionally include wherein rotation of the jamb paddle assembly about the pivot member translates movement in a first direction of one of the first and second latch bolts to the other of the first and second latch bolts in a second direction substantially parallel to the first direction.

Example 16 can include, or can optionally be combined with the subject matter of one or any combination of Examples 11 through 15 to optionally include the latch cam and latch follower extend radially away from the pivot member in different directions.

Example 17 can include, or can optionally be combined with the subject matter of one or any combination of Examples 1 through 16 to optionally include, in a first configuration, the latch follower is biased by the second latch bolt away from a sash associated with the second latch bolt, and in a second configuration, the latch follower is biased by the latch cam toward the sash corresponding to the second latch bolt.

Example 18 can include, or can optionally be combined with the subject matter of one or any combination of Examples 1 through 17 to optionally include an operator remote from both the jamb receiver block and the jamb paddle assembly, the operator engaged with the first latch bolt by a tying element, and the operator includes a movable operator interface feature configured to rotate the jamb paddle assembly about the pivot member to move at least one of the first and second latch bolts between withdrawn and projected positions.

Example 19 can include, or can optionally be combined with the subject matter of one or any combination of Examples 1 through 18 to include subject matter (such as an apparatus, or a method), such as can include a method for using a fenestration operation hardware assembly, including withdrawing a bottom latch bolt coupled to a bottom sash from a second position to a first position according to actuation of an operator interface feature, in the first position the bottom sash is movable within a frame, withdrawing the bottom latch bolt including moving a latch cam of a jamb paddle assembly with the bottom latch bolt, and transmitting movement of the latch cam to a top latch bolt with a latch follower of the jamb paddle assembly, the top latch bolt associated with a top sash.

Example 20 can include, or can optionally be combined with the subject matter of Example 19, to optionally include transmitting movement of the latch cam to the top latch bolt using the latch follower of the jamb paddle assembly, including using a jamb paddle assembly that includes the latch follower and the latch cam coupled to a shared pivot member.

Example 21 can include, or can optionally be combined with the subject matter of one or any combination of Examples 19 or 20 to optionally include withdrawing the bottom latch bolt, including withdrawing the bottom latch bolt to a fully withdrawn position, and, wherein in response to the transmitted portion of the movement of the latch cam to the top latch bolt, the top latch bolt is biased toward a withdrawn position to permit translation of the top sash relative to the frame.

Example 22 can include, or can optionally be combined with the subject matter of one or any combination of Examples 19 through 21 to optionally include tilting the bottom sash when the bottom latch bolt is in the fully withdrawn position.

Example 23 can include, or can optionally be combined with the subject matter of one or any combination of Examples 19 through 22 to optionally include operating an operator interface feature of a remote operator, and operation of the operator interface feature withdraws the first latch bolt.

Example 24 can include, or can optionally be combined with the subject matter of one or any combination of Examples 19 through 23 to optionally include releasing the bottom latch bolt from the first position when the bottom sash is in a closed configuration, releasing the bottom latch bolt comprising deflecting the latch cam laterally away from the bottom latch bolt and receiving a projection of the latch cam in a recess of the bottom latch bolt.

Example 25 can include, or can optionally be combined with any portion or combination of any portions of any one or more of Examples 1 through 24 to include, subject matter that can include means for performing any one or more of the functions of Examples 1 through 24.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The term "machine readable medium" as used herein may include a single medium or multiple media (e.g., a centralized or distributed database, and/or associated caches and servers) that are configured to store the one or more instructions. The term "machine readable medium" may include any medium that is capable of storing, encoding, or carrying instructions for execution by a machine (e.g., by the processor circuit 310 or another processor or computer module) and that cause the machine to perform any one or more of the techniques of the present disclosure, or that is capable of storing, encoding or carrying data structures used by or associated with such instructions. Examples of non-limiting machine readable media are discussed above. The instructions may further be transmitted or received over a communications network using a transmission medium via the network interface device utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), peer-to-peer (P2P) networks, among others. In an example, a network interface device used with the systems described herein may include one or more physical jacks (e.g., Ethernet, coaxial, or phone jacks) or one or more antennas (e.g., the wireless transceiver 312) to connect to the communications network. In an example, the network interface device may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by a machine, and includes digital or analog communications signals or other intangible medium to facilitate communication of such software.

The present disclosure should not be considered limited to the particular examples described above, but rather should be understood to cover all aspects of the disclosure. Various modifications, equivalent processes, as well as numerous structures to which the present disclosure may be applicable will be readily apparent to those of skill in the art to which the present disclosure is directed upon review of the present specification.

What is claimed is:

1. A fenestration operation hardware assembly for a double hung window, the assembly comprising:

a first latch mechanism coupled with a first check rail of a first sash of the window and slidable together with the first sash within a frame, the first latch mechanism including a first latch bolt movable between a projected position and at least a first withdrawn position;

an operator device, operable by a user, to selectively move the first latch bolt between at least the projected position and the first withdrawn position;

a second latch mechanism coupled with a second check rail of a second sash of the window and slidable together with the second sash within the frame, the second latch mechanism including a second latch bolt movable between at least a projected position and a withdrawn position; and a transmission assembly within the frame, the transmission assembly substantially adjacent to the first and second check rails when the first and second sashes are in a closed configuration, and the transmission assembly operatively couples the first and second latch bolts in the closed configuration, and wherein movement of the first latch bolt by the operator device is transmitted to the second latch bolt through the transmission assembly.

2. The assembly of claim 1, wherein the first and second latch mechanisms include respective biasing elements coupled with the first and second latch bolts, and wherein the first and second latch bolts are biased toward their respective projected positions by the respective biasing elements.

3. The assembly of claim 1, wherein the transmission assembly includes first and second recesses that are configured to receive the projected first and second latch bolts, respectively, when the first and second sashes are in the closed configuration.

4. The assembly of claim 3, further comprising a recessed channel in a window frame of the double hung window, wherein the recessed channel is positioned above the first recess of the transmission assembly, and wherein the recessed channel receives a portion of the first latch bolt when the first sash slides within the window frame.

5. The assembly of claim 4, wherein the recessed channel receives the portion of the first latch bolt when the first latch bolt is in the first withdrawn position.

6. The assembly of claim 4, wherein the first recess of the transmission assembly is further recessed into the window frame than the recessed channel in the window frame and an overhang is interposed between the first recess and the recessed channel, wherein the overhang inhibits translation of the first sash when the first latch bolt is in the projected position and seated in the first recess of the transmission assembly.

7. The assembly of claim 1, wherein the first sash is slidable within the window frame with the first latch bolt in a second withdrawn position, and the first sash is arrested from sliding within the window frame with the first latch bolt in the projected position.

8. The assembly of claim 1, wherein the first latch bolt is movable to a second withdrawn position, and with the first latch bolt in the second withdrawn position the first sash is tiltable away from a plane of the window frame.

9. The assembly of claim 1, wherein the transmission assembly includes a latch cam and a cam follower, and wherein movement of the first latch bolt is transmitted from the latch cam to the second latch bolt by the cam follower when the first and second sashes are in the closed configuration.

10. The assembly of claim 9, wherein the first latch bolt includes a cam recess, and wherein the latch cam includes an extension portion that is seated within the cam recess of the first latch bolt with the first sash in the closed configuration, and movement of the first latch bolt is transmitted to the latch cam at the cam recess.

11. A fenestration hardware apparatus for a double hung window, the apparatus comprising:

a transmission assembly configured to couple first and second sashes in a window frame, the transmission assembly rotates with respect to the window frame, and the transmission assembly including:

a pivot having a longitudinal axis;

a cam follower coupled with the pivot and rotatable about the longitudinal axis of the pivot; and a latch cam coupled with the pivot and spaced apart from the cam follower along the longitudinal axis of the pivot, and the latch cam rotatable about the longitudinal axis of the pivot, and the cam follower rotates with the latch cam; and a receiver block that receives the transmission assembly and is installed in the window frame of the double hung window, wherein the receiver block includes first and second recesses that extend into the window frame and that respectively correspond to the latch cam and the cam follower, and wherein the receiver block includes a stopper in the first recess and the stopper arrests withdrawal of a first latch bolt out of the receiver block.

12. The apparatus of claim 11, wherein the latch cam includes a flexible arm that is deflectable substantially in the direction of the longitudinal axis of the pivot.

13. The apparatus of claim 11, wherein the cam follower extends away from the longitudinal axis of the pivot in a first radial direction, and wherein the latch cam extends away from the longitudinal axis of the pivot in a different second radial direction.

14. The apparatus of claim 11, wherein the latch cam extends radially away from the longitudinal axis of the pivot in a first direction, and wherein the latch cam includes an extension portion that is spaced apart from the pivot and extends away from the latch cam in the direction of the longitudinal axis of the pivot.

* * * * *